US011826771B2

(12) United States Patent
Volk et al.

(10) Patent No.: US 11,826,771 B2
(45) Date of Patent: Nov. 28, 2023

(54) SET OF NOZZLES FOR A SPRAY GUN, SPRAY GUN SYSTEM, METHOD FOR EMBODYING A NOZZLE MODULE, METHOD FOR SELECTING A NOZZLE MODULE FROM A SET OF NOZZLES FOR A PAINT JOB, SELECTION SYSTEM AND COMPUTER PROGRAM PRODUCT

(71) Applicant: SATA GMBH & CO. KG, Kornwestheim (DE)

(72) Inventors: Eva Volk, Ludwigsburg (DE); Michael Pantle, Gemmrigheim (DE); Norbert Maier, Allmersbach im Tal (DE); Mazin Mashalla, Stuttgart (DE)

(73) Assignee: SATA GmbH & Co. KG, Kornwestheim (DE)

( * ) Notice: Subject to any disclaimer, the term of this patent is extended or adjusted under 35 U.S.C. 154(b) by 362 days.

(21) Appl. No.: 17/264,372

(22) PCT Filed: Aug. 1, 2018

(86) PCT No.: PCT/DE2018/100679
§ 371 (c)(1),
(2) Date: Jan. 29, 2021

(87) PCT Pub. No.: WO2018/184636
PCT Pub. Date: Oct. 11, 2018

(65) Prior Publication Data
US 2021/0379612 A1 Dec. 9, 2021

(51) Int. Cl.
*B05B 7/08* (2006.01)
*B05B 1/04* (2006.01)
*B05B 1/14* (2006.01)

(52) U.S. Cl.
CPC ..... *B05B 7/0815* (2013.01); *B05B 1/044* (2013.01); *B05B 1/14* (2013.01)

(58) Field of Classification Search
CPC ..... B05B 7/0815; B05B 1/044; B05B 1/14; B05B 15/60; B05B 15/65
(Continued)

(56) References Cited

U.S. PATENT DOCUMENTS 40,433 A 10/1863 Sees
327,260 A 9/1885 Hart
(Continued)

FOREIGN PATENT DOCUMENTS

AT 153883 6/1997
AT 163577 3/1998
(Continued)

OTHER PUBLICATIONS

Office Action, dated Jan. 15, 2019, for U.S. Appl. No. 15/679,533.
(Continued)

*Primary Examiner* — Steven J Ganey
(74) *Attorney, Agent, or Firm* — Paul D. Bianco; Fleit Intellectual Property Law

(57) ABSTRACT

A set of nozzles for a spray gun, especially a compressed-air paint spray gun, comprises at least one nozzle module group with at least two different nozzle modules for mounting in or on the same base module of a spray gun. The nozzle modules have different medium flow rates under the same spray conditions, the spray jets generated by the nozzle modules having substantially the same spray jet section height and the same spray jet section width, the spray jet sections of the different nozzle modules in particular being congruent. A spray gun system, a method for embodying a nozzle module, a method for selecting a nozzle module from a set of nozzles for a paint job, a selection system, in particular a "slide gate system", and a computer program product are also disclosed. The user can select the nozzle module which is ideal for the paint job and mode of operation in question.

15 Claims, 3 Drawing Sheets

(58) Field of Classification Search
USPC ..... 239/418, 296, 390
See application file for complete search history.

(56) References Cited

U.S. PATENT DOCUMENTS

| | | | |
|---|---|---|---|
| 459,432 | A | 9/1891 | Anderson |
| 459,433 | A | 9/1891 | Avery |
| 548,816 | A | 10/1895 | Paul |
| 552,213 | A | 12/1895 | Troy |
| 552,715 | A | 1/1896 | Lugrin |
| 563,505 | A | 7/1896 | McCornack |
| 581,107 | A | 4/1897 | Emery |
| 644,803 | A | 3/1900 | Justi |
| 672,012 | A | 4/1901 | Ruper |
| 574,880 | A | 5/1901 | Schmidt et al. |
| 1,662,496 | A | 3/1928 | Forsgard |
| 1,703,383 | A | 2/1929 | Birkenmaier |
| 1,703,384 | A | 2/1929 | Birkenmaier |
| 1,711,221 | A | 4/1929 | Blakeslee |
| 1,751,787 | A | 3/1930 | Binks |
| 1,889,201 | A | 11/1932 | Holveck |
| 2,004,303 | A | 6/1935 | Wahlin |
| 2,008,381 | A | 7/1935 | Beeg |
| 2,049,700 | A | 8/1936 | Gustafson |
| 2,051,210 | A | 8/1936 | Gustafsson |
| 2,070,696 | A | 2/1937 | Tracy |
| 2,116,036 | A | 5/1938 | Money |
| 2,125,445 | A | 8/1938 | Holveck |
| 2,198,441 | A | 4/1940 | Mollart |
| 2,204,599 | A | 6/1940 | Jenkins |
| 2,269,057 | A | 1/1942 | Jenkins |
| D133,223 | S | 7/1942 | Tammen |
| 2,356,865 | A | 8/1944 | Mason |
| 2,416,856 | A | 3/1947 | Thomsen |
| 2,416,923 | A | 3/1947 | Jenkins |
| 2,470,718 | A | 5/1949 | Peeps |
| 2,533,953 | A | 12/1950 | Peeps |
| 2,557,593 | A | 6/1951 | Bjorkman |
| 2,557,606 | A | 6/1951 | Liedberg |
| 2,559,091 | A | 7/1951 | Reasenberg |
| 2,609,961 | A | 9/1952 | Sapien |
| 2,612,899 | A | 10/1952 | Webb |
| 2,646,314 | A | 7/1953 | Peeps |
| 2,721,004 | A | 10/1955 | Schultz |
| 2,743,963 | A | 5/1956 | Peeps |
| 2,844,267 | A | 7/1958 | Petriccione |
| 2,886,252 | A | 5/1959 | Ehrensperger |
| 3,090,530 | A | 5/1963 | Peeps |
| D196,477 | S | 10/1963 | Kelly |
| 3,159,472 | A | 12/1964 | Revell |
| D200,594 | S | 3/1965 | Sass |
| 3,240,398 | A | 3/1966 | Dalton, Jr. |
| D204,306 | S | 4/1966 | Hamm |
| D205,760 | S | 9/1966 | Hocutt et al. |
| D208,903 | S | 10/1967 | Zadron et al. |
| 3,344,992 | A | 10/1967 | Norris |
| 3,381,845 | A | 5/1968 | MacDonald |
| 3,417,650 | A | 12/1968 | Varrin |
| 3,420,106 | A | 1/1969 | Keller et al. |
| 3,435,683 | A | 4/1969 | Keller et al. |
| 3,482,781 | A | 12/1969 | Sharpe |
| D217,928 | S | 6/1970 | Felske |
| 3,524,589 | A | 8/1970 | Pelton, Jr. |
| 3,527,372 | A | 9/1970 | Manning |
| 3,583,632 | A | 6/1971 | Schaffer |
| 3,622,078 | A | 11/1971 | Gronert |
| 3,645,562 | A | 2/1972 | Fandetti et al. |
| 3,656,493 | A | 4/1972 | Black et al. |
| 3,714,967 | A | 2/1973 | Zupan et al. |
| 3,746,253 | A | 7/1973 | Walberg |
| 3,747,850 | A | 7/1973 | Hastings et al. |
| 3,771,539 | A | 11/1973 | De Santis |
| 3,840,143 | A | 10/1974 | Davis et al. |
| 3,848,807 | A | 11/1974 | Partida |
| 3,857,511 | A | 12/1974 | Govindan |
| 3,870,223 | A | 3/1975 | Wyant |
| 3,873,023 | A | 3/1975 | Moss et al. |
| 3,938,739 | A | 2/1976 | Bertilsson et al. |
| 4,000,915 | A | 1/1977 | Strom |
| D245,048 | S | 7/1977 | Pool |
| D252,097 | S | 6/1979 | Probst et al. |
| 4,160,525 | A | 7/1979 | Wagner |
| 4,171,091 | A | 10/1979 | van Hardeveld et al. |
| 4,210,263 | A | 7/1980 | Bos |
| 4,273,293 | A | 6/1981 | Hastings |
| 4,278,276 | A | 7/1981 | Ekman |
| 4,411,387 | A | 10/1983 | Stern et al. |
| 4,478,370 | A | 10/1984 | Hastings |
| D276,472 | S | 11/1984 | Harrison |
| D278,543 | S | 4/1985 | Gintz |
| 4,545,536 | A | 10/1985 | Avidon |
| 4,562,965 | A | 1/1986 | Ihmels et al. |
| 4,572,437 | A | 2/1986 | Huber et al. |
| 4,580,035 | A | 4/1986 | Luscher |
| 4,585,168 | A | 4/1986 | Even et al. |
| 4,614,300 | A | 9/1986 | Falcoff |
| 4,643,330 | A | 2/1987 | Kennedy |
| 4,653,661 | A | 3/1987 | Buchner et al. |
| 4,667,878 | A | 5/1987 | Behr |
| 4,713,257 | A | 12/1987 | Luttermoeller |
| D293,950 | S | 1/1988 | Ogden et al. |
| 4,730,753 | A | 3/1988 | Grime |
| 4,767,057 | A | 8/1988 | Degli et al. |
| D298,372 | S | 11/1988 | Taylor, Jr. |
| 4,784,184 | A | 11/1988 | Gates |
| 4,806,736 | A | 2/1989 | Schirico |
| 4,826,539 | A | 5/1989 | Harpold |
| 4,832,232 | A | 5/1989 | Broccoli |
| 4,844,347 | A | 7/1989 | Konhäuser |
| 4,854,504 | A | 8/1989 | Hedger, Jr. et al. |
| 4,863,781 | A | 9/1989 | Kronzer |
| 4,877,144 | A | 10/1989 | Thanisch |
| D305,057 | S | 12/1989 | Morgan |
| 4,887,747 | A | 12/1989 | Ostrowsky et al. |
| 4,901,761 | A | 2/1990 | Taylor |
| 4,906,151 | A | 3/1990 | Kubis |
| 4,917,300 | A | 4/1990 | Gloviak et al. |
| 4,946,075 | A | 8/1990 | Lundback |
| 4,964,361 | A | 10/1990 | Aebersold |
| 4,967,600 | A | 11/1990 | Keller |
| 4,969,603 | A | 11/1990 | Norman |
| 4,973,184 | A | 11/1990 | La Salle |
| D314,421 | S | 2/1991 | Tajima et al. |
| D314,588 | S | 2/1991 | Denham |
| 4,989,787 | A | 2/1991 | Nikkel et al. |
| 5,020,700 | A | 6/1991 | Krzywdziak et al. |
| D318,877 | S | 8/1991 | Miranda et al. |
| 5,042,840 | A | 8/1991 | Rieple et al. |
| D321,597 | S | 11/1991 | Cerny |
| 5,064,119 | A | 11/1991 | Mellette |
| 5,071,074 | A | 12/1991 | Lind |
| 5,074,334 | A | 12/1991 | Onodera |
| 5,078,323 | A | 1/1992 | Frank |
| 5,080,285 | A | 1/1992 | Toth |
| 5,088,648 | A | 2/1992 | Schmon |
| 5,090,623 | A | 2/1992 | Burns et al. |
| 5,102,045 | A | 4/1992 | Diana |
| 5,119,992 | A | 6/1992 | Grime |
| 5,125,391 | A | 6/1992 | Srivastava et al. |
| 5,135,124 | A | 8/1992 | Wobser |
| 5,143,102 | A | 9/1992 | Blaul |
| 5,165,605 | A | 11/1992 | Morita |
| 5,170,941 | A | 12/1992 | Morita et al. |
| 5,190,219 | A | 3/1993 | Copp, Jr. |
| 5,191,797 | A | 3/1993 | Smith |
| 5,209,405 | A | 5/1993 | Robinson |
| 5,228,488 | A | 7/1993 | Fletcher |
| 5,232,299 | A | 8/1993 | Hiss |
| 5,236,128 | A | 8/1993 | Morita et al. |
| 5,249,746 | A | 10/1993 | Kaneko et al. |
| D341,186 | S | 11/1993 | Albers |
| 5,289,974 | A | 3/1994 | Grime et al. |
| 5,322,221 | A | 6/1994 | Anderson |
| 5,325,473 | A | 6/1994 | Monroe et al. |

(56) References Cited

U.S. PATENT DOCUMENTS 5,332,156 A 7/1994 Wheeler
5,333,506 A 8/1994 Smith et al.
5,333,908 A 8/1994 Dorney et al.
5,344,078 A 9/1994 Fritz et al.
5,367,148 A 11/1994 Storch et al.
D353,836 S 12/1994 Carvelli et al.
5,381,962 A 1/1995 Teague
5,435,491 A 7/1995 Sakuma
5,443,642 A 8/1995 Bienduga
5,456,414 A 10/1995 Burns et al.
D365,952 S 1/1996 Gagnon et al.
5,503,439 A 4/1996 LaJeunesse et al.
5,529,245 A 6/1996 Brown
5,533,674 A 7/1996 Feyrer et al.
5,540,385 A 7/1996 Garlick
5,540,386 A 7/1996 Roman
D376,637 S 12/1996 Kieffer
5,582,350 A 12/1996 Kosmyna et al.
5,584,899 A 12/1996 Shorts
5,588,562 A 12/1996 Sander et al.
5,592,597 A 1/1997 Kiss
5,609,302 A 3/1997 Smith
5,613,637 A 3/1997 Schmon
D380,301 S 7/1997 Kogutt
5,655,714 A 8/1997 Kieffer et al.
5,662,444 A 9/1997 Schmidt, Jr.
5,667,143 A 9/1997 Sebion et al.
5,695,125 A 12/1997 Kumar
5,704,381 A 1/1998 Millan et al.
5,718,767 A 2/1998 Crum et al.
D391,403 S 3/1998 Josephs
5,725,161 A 3/1998 Hartle
RE35,769 E 4/1998 Grime et al.
5,755,363 A 5/1998 Gantner et al.
5,762,228 A 6/1998 Morgan et al.
5,803,360 A 9/1998 Spitznagel
5,816,501 A 10/1998 LoPresti et al.
5,829,682 A 11/1998 Haruch
5,836,517 A 11/1998 Burns et al.
D402,820 S 12/1998 Morison et al.
5,843,515 A 12/1998 Crum et al.
5,853,014 A 12/1998 Rosenauer
D405,503 S 2/1999 Edo
5,874,680 A 2/1999 Moore
5,884,006 A 3/1999 Frohlich et al.
D409,719 S 5/1999 Kaneko
5,941,461 A 8/1999 Akin et al.
5,951,190 A 9/1999 Wilson
5,951,296 A 9/1999 Klein
5,954,268 A 9/1999 Joshi et al.
D414,636 S 10/1999 Wiese
5,979,797 A 11/1999 Castellano
5,992,763 A 11/1999 Smith et al.
6,006,930 A 12/1999 Dreyer et al.
6,010,082 A 1/2000 Peterson
6,017,394 A 1/2000 Crum et al.
6,019,294 A 2/2000 Anderson
6,036,109 A 3/2000 DeYoung
6,039,218 A 3/2000 Beck
6,050,499 A 4/2000 Takayama
6,053,429 A 4/2000 Chang
6,056,213 A 5/2000 Ruta et al.
6,056,215 A 5/2000 Hansinger
6,089,471 A 7/2000 Scholl
6,089,607 A 7/2000 Keeney et al.
6,091,053 A 7/2000 Aonuma
6,092,740 A 7/2000 Liu
6,132,511 A 10/2000 Crum et al.
D435,379 S 12/2000 Nguyen
6,230,986 B1 5/2001 Vacher et al.
6,250,567 B1 6/2001 Lewis et al.
6,267,301 B1 7/2001 Haruch
6,276,616 B1 8/2001 Jenkins
D448,451 S 9/2001 Turnbull et al.
6,308,991 B1 10/2001 Royer
D457,599 S 5/2002 Karwoski et al.
D459,432 S 6/2002 Schmon
D459,433 S 6/2002 Schmon
6,402,058 B2 6/2002 Kaneko et al.
6,402,062 B1 6/2002 Bending et al.
6,431,466 B1 8/2002 Kitajima
6,435,426 B1 8/2002 Copp, Jr.
6,442,276 B1 8/2002 Doljack
6,450,422 B1 9/2002 Maggio
6,494,387 B1 12/2002 Kaneko
6,536,684 B1 3/2003 Wei
6,536,687 B1 3/2003 Navis et al.
D472,730 S 4/2003 Sparkowski
6,540,114 B1 4/2003 Popovich et al.
6,543,632 B1 4/2003 McIntyre et al.
6,547,160 B1 4/2003 Huang
6,547,884 B1 4/2003 Crum et al.
6,553,712 B1 4/2003 Majerowski et al.
6,554,009 B1 4/2003 Beijbom et al.
D474,528 S 5/2003 Huang
6,585,173 B2 7/2003 Schmon et al.
6,595,441 B2 7/2003 Petrie et al.
6,612,506 B1 9/2003 Huang
6,626,382 B1 9/2003 Liu
6,626,383 B1 9/2003 Campbell
6,647,997 B2 11/2003 Mohn
6,661,438 B1 12/2003 Shiraishi et al.
D485,685 S 1/2004 Zupkofska et al.
6,675,845 B2 1/2004 Volpenheim et al.
6,692,118 B2 2/2004 Michele et al.
6,712,292 B1 3/2004 Gosis et al.
6,717,584 B2 4/2004 Kulczycka
6,732,751 B2 5/2004 Chiang
6,763,964 B1 7/2004 Hurlbut et al.
6,766,763 B2 7/2004 Crum et al.
6,786,345 B2 9/2004 Richards
6,796,514 B1 9/2004 Schwartz
6,801,211 B2 10/2004 Forsline et al.
6,820,824 B1 11/2004 Joseph et al.
6,843,390 B1 1/2005 Bristor
6,845,924 B2 1/2005 Schmon
6,855,173 B2 2/2005 Ehrnsperger et al.
6,863,310 B1 3/2005 Petkovsek
6,863,920 B2 3/2005 Crum et al.
6,874,656 B2 4/2005 Rohr et al.
6,874,664 B1 4/2005 Montgomery
6,874,708 B2 4/2005 Reetz, III
6,877,677 B2 4/2005 Schmon et al.
6,929,019 B2 8/2005 Weinmann et al.
6,945,429 B2 9/2005 Gosis et al.
6,955,180 B2 10/2005 Kocherlakota et al.
6,962,432 B2 11/2005 Hofeldt
6,963,331 B1 11/2005 Kobayashi et al.
7,017,838 B2 3/2006 Schmon
7,018,154 B2 3/2006 Schmon
D519,687 S 4/2006 Zahav
7,032,839 B2 4/2006 Biette
7,036,752 B1 5/2006 Hsiang
7,083,119 B2 8/2006 Bouic et al.
7,090,148 B2 8/2006 Petrie et al.
7,097,118 B1 8/2006 Huang
D528,192 S 9/2006 Nicholson
7,106,343 B1 9/2006 Hickman
7,165,732 B2 1/2007 Kosmyna et al.
7,172,139 B2 2/2007 Bouic et al.
7,175,110 B2 2/2007 Vicentini
7,182,213 B2 2/2007 King
D538,050 S 3/2007 Tardif
D538,493 S 3/2007 Zimmerle et al.
D538,886 S 3/2007 Huang
7,194,829 B2 3/2007 Boire et al.
D541,053 S 4/2007 Sanders
D541,088 S 4/2007 Nesci
7,201,336 B2 4/2007 Blette et al.
7,216,813 B2 5/2007 Rogers
D545,943 S 7/2007 Rodgers et al.
7,246,713 B2 7/2007 King
7,249,519 B2 7/2007 Rogers
D548,816 S 8/2007 Schmon

(56) References Cited

U.S. PATENT DOCUMENTS 7,255,293 B2 8/2007 Dodd
7,264,131 B2 9/2007 Tsutsumi et al.
D552,213 S 10/2007 Schmon
D552,715 S 10/2007 Schmon
D554,703 S 11/2007 Josephson
7,328,855 B2 2/2008 Chatron et al.
D563,505 S 3/2008 Schmon
7,374,111 B2 5/2008 Joseph et al.
D571,463 S 6/2008 Chesnin
7,384,004 B2 6/2008 Rogers
RE40,433 E 7/2008 Schmon
D573,227 S 7/2008 Mirazita et al.
D574,926 S 8/2008 Huang
D575,374 S 8/2008 Huang
7,410,106 B2 8/2008 Escoto, Jr. et al.
7,416,140 B2 8/2008 Camilleri et al.
7,422,164 B2 9/2008 Matsumoto
D579,213 S 10/2008 Aipa
D581,107 S 11/2008 Schmon
D581,483 S 11/2008 Bass et al.
D583,013 S 12/2008 Wang
7,458,612 B1 12/2008 Bennett
7,472,840 B2 * 1/2009 Gregory ..... B05B 15/74 239/390
D588,231 S 3/2009 Pellin
7,533,678 B2 5/2009 Rosa
7,540,434 B2 6/2009 Gohring et al.
7,542,032 B2 6/2009 Kruse
7,568,638 B2 8/2009 Gehrung
D604,394 S 11/2009 Wang
7,614,571 B2 11/2009 Camilleri et al.
D607,086 S 12/2009 Kosaka
7,624,869 B2 12/2009 Primer
D607,972 S 1/2010 Wang
D608,858 S 1/2010 Baltz et al.
D614,731 S 4/2010 Wang
7,694,893 B2 4/2010 Zittel et al.
7,694,896 B2 4/2010 Turnbull et al.
D615,586 S 5/2010 Kudimi
D616,022 S 5/2010 Kudimi
D616,527 S 5/2010 Anderson et al.
7,765,876 B1 8/2010 Chen
D624,668 S 9/2010 Noppe
7,810,744 B2 10/2010 Schmon et al.
7,819,341 B2 10/2010 Schmon et al.
D627,039 S 11/2010 Yu
D627,432 S 11/2010 Escoto et al.
7,823,806 B2 11/2010 Schmon
D629,623 S 12/2010 Lampe
7,856,940 B2 12/2010 Wendler
7,913,938 B2 3/2011 Cooper
7,922,107 B2 4/2011 Fox
D637,269 S 5/2011 Wang
D638,121 S 5/2011 Villasana
D639,863 S 6/2011 Langan
D641,067 S 7/2011 Wang
D644,716 S 9/2011 Gehrung
D644,803 S 9/2011 Schmon
D645,094 S 9/2011 Langan
8,042,402 B2 10/2011 Brown et al.
D649,196 S 11/2011 Langan
8,052,071 B2 11/2011 Kruse
D655,347 S 3/2012 Gehrung
8,127,963 B2 3/2012 Gerson et al.
D657,276 S 4/2012 Brose
D661,492 S 6/2012 Ranschau
D661,742 S 6/2012 Clark
D663,960 S 7/2012 Jeronimo
8,225,892 B2 7/2012 Ben-Tzvi
D664,773 S 8/2012 Papin
8,240,579 B1 8/2012 Bennett
8,297,536 B2 10/2012 Ruda
D670,085 S 11/2012 Brookman et al.
D671,988 S 12/2012 Leipold
D672,012 S 12/2012 Brose et al.
D674,880 S 1/2013 Schmon
8,352,744 B2 1/2013 Kruse
8,360,345 B2 1/2013 Micheli
D681,162 S 4/2013 Kruse
8,444,067 B2 5/2013 Schmon et al.
8,454,759 B2 6/2013 Selsvik
8,481,124 B2 7/2013 Nolte et al.
D689,590 S 9/2013 Brose
D689,593 S 9/2013 Schmon
D690,799 S 10/2013 Maier
D692,530 S 10/2013 Gehrung
D692,532 S 10/2013 Li et al.
8,616,434 B2 12/2013 Wilen
D697,584 S 1/2014 Schmon
D698,008 S 1/2014 Schmon et al.
8,626,674 B2 1/2014 Whitehouse
8,642,131 B2 2/2014 Nolte et al.
D704,300 S 5/2014 Li et al.
8,757,182 B2 6/2014 Schmon
8,807,460 B2 8/2014 Charpie et al.
8,857,732 B2 10/2014 Brose
D720,015 S 12/2014 Kruse
D720,041 S 12/2014 Robinson
8,899,501 B2 12/2014 Fox et al.
D721,785 S 1/2015 Gehrung
8,925,836 B2 1/2015 Dettlaff
D733,369 S 6/2015 Tschan
D733,453 S 7/2015 Tschan
D734,428 S 7/2015 Wang
D734,429 S 7/2015 Wang
D734,571 S 7/2015 Tschan
9,073,068 B2 7/2015 Krayer et al.
D737,126 S 8/2015 Tschan
D740,393 S 10/2015 Gehrung
D745,636 S 12/2015 Lin
9,220,853 B2 12/2015 Vogt
D757,216 S 5/2016 Gherung
D758,533 S 6/2016 Dettlaff
D758,537 S 6/2016 Gehrung
D768,820 S 10/2016 Binz
D770,593 S 11/2016 Gehrung
9,498,788 B2 11/2016 Kosaka
9,533,317 B2 1/2017 Gehrung
D792,557 S 7/2017 Wang
D794,756 S 8/2017 Wang
9,782,784 B2 10/2017 Schmon et al.
9,878,336 B2 1/2018 Gehrung
9,878,340 B2 1/2018 Schmon et al.
D835,235 S 12/2018 Gehrung et al.
10,189,037 B2 1/2019 Schmon et al.
10,247,313 B2 4/2019 Chien
10,464,076 B2 11/2019 Sata
10,471,449 B2 11/2019 Gehrung
10,702,879 B2 7/2020 Gehrung
D929,838 S 9/2021 Tschan
11,141,747 B2 10/2021 Schmon
2001/0004996 A1 6/2001 Schmon
2001/0040192 A1 11/2001 Kaneko et al.
2002/0092928 A1 * 7/2002 Conroy ..... B05B 1/1654 239/390
2002/0134861 A1 9/2002 Petrie et al.
2002/0148501 A1 10/2002 Shieh
2002/0170978 A1 11/2002 Mohn
2003/0006322 A1 1/2003 Hartle et al.
2003/0025000 A1 2/2003 Schmon
2003/0066218 A1 4/2003 Schweikert
2003/0121476 A1 7/2003 McIntyre et al.
2003/0127046 A1 7/2003 Zehner et al.
2003/0164408 A1 9/2003 Schmon
2003/0173419 A1 9/2003 Huang
2003/0177979 A1 9/2003 Crum et al.
2003/0189105 A1 10/2003 Schmon
2003/0209568 A1 11/2003 Douglas et al.
2003/0213857 A1 11/2003 Schmon et al.
2003/0218596 A1 11/2003 Eschler
2003/0230636 A1 12/2003 Rogers
2004/0046051 A1 3/2004 Santa Cruz et al.
2004/0050432 A1 3/2004 Breda
2004/0104194 A1 6/2004 Dennison

(56) References Cited

U.S. PATENT DOCUMENTS

2004/0129738 A1 7/2004 Stukas
2004/0140373 A1 7/2004 Joseph et al.
2004/0155063 A1 8/2004 Hofeldt
2004/0159720 A1 8/2004 Komornicki
2004/0177890 A1 9/2004 Weinmann
2004/0191406 A1 9/2004 Crum et al.
2004/0217201 A1 11/2004 Ruda
2004/0233223 A1 11/2004 Schkolne et al.
2004/0245208 A1 12/2004 Dennison
2005/0001060 A1 1/2005 Robinson
2005/0056613 A1 3/2005 King
2005/0082249 A1 4/2005 King
2005/0127201 A1 6/2005 Matsumoto
2005/0145723 A1 7/2005 Blette et al.
2005/0145724 A1 7/2005 Blette et al.
2005/0161525 A1 7/2005 Johansson
2005/0178854 A1 8/2005 Dodd
2005/0189445 A1 9/2005 Hartle et al.
2005/0215284 A1 9/2005 Su
2005/0218246 A1 10/2005 Chatron
2005/0220943 A1 10/2005 Abrams et al.
2005/0248148 A1 11/2005 Schenck et al.
2005/0252993 A1 11/2005 Rogers
2005/0252994 A1 11/2005 Rogers
2005/0268949 A1 12/2005 Rosa
2005/0284963 A1 12/2005 Reedy
2006/0000927 A1 1/2006 Ruda
2006/0007123 A1 1/2006 Wilson et al.
2006/0048803 A1 3/2006 Jessup et al.
2006/0081060 A1 4/2006 Forster
2006/0108449 A1* 5/2006 Sodemann ..... B05B 9/007 239/390
2006/0113409 A1 6/2006 Camilleri et al.
2006/0118661 A1 6/2006 Hartle
2006/0131151 A1 6/2006 Marchand
2006/0171771 A1 8/2006 Kruse
2006/0192377 A1 8/2006 Bauer et al.
2006/0196891 A1 9/2006 Gerson et al.
2007/0029788 A1 2/2007 Adler
2007/0055883 A1 3/2007 Kruse
2007/0131795 A1 6/2007 Abbale et al.
2007/0158349 A1 7/2007 Schmon et al.
2007/0205305 A1 9/2007 Vagedes
2007/0221754 A1 9/2007 Gehrung
2007/0228190 A1 10/2007 Tanner
2007/0252378 A1 11/2007 Chambers
2007/0262169 A1 11/2007 Wang
2007/0262172 A1* 11/2007 Huffman ..... B05B 7/066 239/390
2008/0011879 A1 1/2008 Gerson et al.
2008/0019789 A1 1/2008 Dunaway et al.
2008/0029619 A1 2/2008 Gohring et al.
2008/0128533 A1 6/2008 Gehrung
2008/0179763 A1 7/2008 Schmon et al.
2008/0251607 A1 10/2008 Krayer et al.
2008/0251977 A1 10/2008 Naruse et al.
2008/0264892 A1 10/2008 Nozawa
2008/0272213 A1 11/2008 Ting
2008/0296410 A1 12/2008 Carey et al.
2009/0014557 A1 1/2009 Schmon et al.
2009/0026288 A1 1/2009 Shih
2009/0026290 A1 1/2009 Fox
2009/0045623 A1 2/2009 Schmon
2009/0072050 A1 3/2009 Ruda
2009/0078789 A1 3/2009 Kruse
2009/0078790 A1 3/2009 Camilleri et al.
2009/0143745 A1 6/2009 Langan et al.
2009/0152382 A1 6/2009 Charpie
2009/0179081 A1 7/2009 Charpie
2009/0183516 A1 7/2009 Appler et al.
2009/0235864 A1 9/2009 Khoury et al.
2009/0266915 A1 10/2009 Fedorov
2010/0021646 A1 1/2010 Nolte et al.
2010/0059533 A1 3/2010 Unger et al.
2010/0084493 A1 4/2010 Troudt
2010/0108783 A1 5/2010 Joseph et al.
2010/0126541 A1 5/2010 Schmon
2010/0163649 A1 7/2010 Bass et al.
2010/0206963 A1 8/2010 Huang
2010/0270390 A1 10/2010 Reitz
2010/0270400 A1 10/2010 Evar et al.
2011/0024524 A1 2/2011 Fox
2011/0125607 A1 5/2011 Wilen
2011/0121103 A1 6/2011 Carleton et al.
2011/0127767 A1 6/2011 Wicks et al.
2011/0168811 A1 7/2011 Fox et al.
2011/0174901 A1 7/2011 Dettlaff et al.
2012/0012671 A1 1/2012 Brose et al.
2012/0097762 A1 4/2012 Gehrung et al.
2012/0132550 A1 5/2012 Gerson et al.
2012/0160935 A1 6/2012 Krayer et al.
2012/0187220 A1 7/2012 Micheli et al.
2013/0056556 A1 3/2013 Schmon et al.
2013/0074864 A1 3/2013 Nuzzo et al.
2013/0092760 A1* 4/2013 Joseph ..... B05B 7/2478 239/418
2013/0266734 A1 10/2013 Nolte et al.
2013/0320110 A1 12/2013 Brose et al.
2013/0327850 A1 12/2013 Joseph
2014/0034757 A1 2/2014 Kaneko et al.
2014/0048627 A1 2/2014 Schmon et al.
2014/0059905 A1 3/2014 Raming
2014/0145003 A1 5/2014 Schmon et al.
2014/0263686 A1 9/2014 Hedger
2014/0305962 A1 10/2014 Tschan
2014/0339322 A1* 11/2014 Freers ..... B05C 11/02 239/390
2014/0346257 A1 11/2014 Reetz, III et al.
2015/0108254 A1 4/2015 Commette
2015/0165463 A1 6/2015 Gehrung
2015/0231655 A1 8/2015 Adams et al.
2016/0030960 A1 2/2016 Gehrung
2017/0252771 A1 9/2017 Young, II
2017/0304852 A1 10/2017 Bierie
2018/0050355 A1 2/2018 Delsard
2018/0050356 A1 2/2018 Gehrung et al.
2018/0050361 A1 2/2018 Gehrung
2018/0050362 A1 2/2018 Gehrung et al.
2018/0133727 A1 5/2018 Schmon et al.
2018/0200740 A1 7/2018 Rossbach et al.
2020/0038889 A1 2/2020 Volk
2020/0038892 A1 2/2020 Volk et al.
2022/0048054 A1 2/2022 Maier
2022/0080448 A1 3/2022 Volk
2023/0107860 A1 4/2023 Maier

FOREIGN PATENT DOCUMENTS

AT 250467 10/2003
AT 322645 4/2006
AT 383910 2/2008
AT 461752 4/2010
AT 461753 4/2010
AT 475488 8/2010
AU 637187 5/1993
AU 2002352235 9/2003
AU 2004315547 8/2005
AU 2005205899 8/2005
AU 2011257605 11/2012
AU 2011361295 5/2013
CA 521511 2/1956
CA 2126957 1/1995
CA 2277096 7/1998
CA 2445183 10/2002
CA 2552390 8/2005
CA 2555607 8/2005
CA 2690112 5/2009
CA 2797990 12/2011
CA 2812684 9/2012
CA 102917803 2/2013
CA 2850401 A1 5/2013
CH 200754 A 10/1938
CH 203 668 6/1939
CH 523 098 A 5/1972

(56) References Cited

FOREIGN PATENT DOCUMENTS

| | | | |
|---|---|---|---|
| CH | 523098 | A | 5/1972 |
| CH | 542104 | A | 9/1973 |
| CH | 676208 | | 12/1990 |
| CN | 2136077 | Y | 6/1993 |
| CN | 1738310 | A | 2/2006 |
| CN | 1899704 | A | 1/2007 |
| CN | 1902002 | | 1/2007 |
| CN | 1909970 | | 2/2007 |
| CN | 1909971 | | 2/2007 |
| CN | 1917960 | | 2/2007 |
| CN | 200954482 | | 10/2007 |
| CN | 101125316 | | 2/2008 |
| CN | 201064746 | Y | 5/2008 |
| CN | 100430150 | | 11/2008 |
| CN | 100455360 | | 1/2009 |
| CN | 101367066 | | 2/2009 |
| CN | 100478080 | | 4/2009 |
| CN | 101516523 | A | 8/2009 |
| CN | 101646500 | | 2/2010 |
| CN | 102211070 | | 4/2011 |
| CN | 102139249 | A | 8/2011 |
| CN | 102211069 | | 10/2011 |
| CN | 202667052 | U | 1/2013 |
| CN | 103 521 378 | A | 1/2014 |
| CN | 103521378 | A | 1/2014 |
| CN | 203508251 | U | 4/2014 |
| CN | 203737474 | U | 7/2014 |
| CN | 204074345 | U | 1/2015 |
| CN | 204294401 | U | 4/2015 |
| CN | 105377447 | A | 3/2016 |
| CN | 205966208 | U | 2/2017 |
| CN | 107427851 | A | 12/2017 |
| CN | 107666966 | A | 2/2018 |
| CN | 108223901 | A | 6/2018 |
| CN | 207493903 | U | 6/2018 |
| CN | 108438227 | A | 8/2018 |
| DE | 259621 | C | 5/1913 |
| DE | 460381 | | 5/1928 |
| DE | 510362 | | 10/1930 |
| DE | 611325 | C | 3/1935 |
| DE | 1425890 | | 11/1968 |
| DE | 2559036 | | 9/1976 |
| DE | 2653981 | | 6/1978 |
| DE | 2950341 | | 7/1980 |
| DE | 2926286 | A1 | 1/1981 |
| DE | 3016419 | | 11/1981 |
| DE | 8024829.9 | | 9/1982 |
| DE | 3111571 | A1 | 10/1982 |
| DE | 3238149 | A1 | 4/1984 |
| DE | 34 02 097 | | 8/1985 |
| DE | 3402945 | A1 | 8/1985 |
| DE | 3517122 | | 5/1986 |
| DE | 3505618 | | 8/1986 |
| DE | 3526819 | | 2/1987 |
| DE | 3016419 | C2 | 8/1987 |
| DE | 8702559 | | 10/1987 |
| DE | 3708472 | A1 | 10/1988 |
| DE | 8902223 | | 5/1989 |
| DE | 3742308 | | 6/1989 |
| DE | 8905681 | | 11/1989 |
| DE | G 90 01 265 | | 5/1990 |
| DE | 3906219 | | 8/1990 |
| DE | 4302911 | | 8/1993 |
| DE | 4208500 | A1 | 9/1993 |
| DE | 4230535 | | 3/1994 |
| DE | G 94 16 015.5 | U1 | 11/1994 |
| DE | 4321940 | | 1/1995 |
| DE | 69211 891 | T2 | 10/1996 |
| DE | 69211891 | T2 | 10/1996 |
| DE | 19516485 | | 11/1996 |
| DE | 19727884 | | 2/1999 |
| DE | 69505433 | T2 | 4/1999 |
| DE | 19807973 | | 7/1999 |
| DE | 19824264 | | 12/1999 |
| DE | 19832990 | | 1/2000 |
| DE | 20000483 | | 8/2000 |
| DE | 10004105 | | 10/2000 |
| DE | 19958569 | | 2/2001 |
| DE | 199 41 362 | | 3/2001 |
| DE | 199 45 760 | | 3/2001 |
| DE | 19945760 | | 3/2001 |
| DE | 10103221 | A1 | 8/2001 |
| DE | 10031857 | | 1/2002 |
| DE | 10031858 | | 1/2002 |
| DE | 20114257 | | 2/2002 |
| DE | 10059406 | | 6/2002 |
| DE | 10135104 | | 9/2002 |
| DE | 10135104 | C1 | 9/2002 |
| DE | 102 05 831 | | 8/2003 |
| DE | 10205831 | | 8/2003 |
| DE | 10311238 | | 10/2004 |
| DE | 10 2004 027 789 | | 2/2005 |
| DE | 29825120 | | 2/2005 |
| DE | 102004027789 | A1 | 2/2005 |
| DE | 69827994 | | 4/2005 |
| DE | 69827994 | T2 | 4/2005 |
| DE | 20320781 | | 6/2005 |
| DE | 10 2004 014 646 | | 7/2005 |
| DE | 10 2004 003 438 | | 8/2005 |
| DE | 102004003439 | | 8/2005 |
| DE | 10 2004 007 733 | | 9/2005 |
| DE | 10 2004 021 298 | | 11/2005 |
| DE | 699 28 944 | T2 | 9/2006 |
| DE | 69928944 | T2 | 9/2006 |
| DE | 69535077 | T2 | 11/2006 |
| DE | 202007001031 | | 3/2007 |
| DE | 60200500 1173 | | 8/2007 |
| DE | 60206956 | T2 | 8/2008 |
| DE | 102007006547 | | 8/2008 |
| DE | 102007013628 | A1 | 9/2008 |
| DE | 102007039106 | | 2/2009 |
| DE | 102007052067 | | 5/2009 |
| DE | 10 2009 020 194 | A1 | 11/2010 |
| DE | 20 2010 012 449 | U1 | 12/2010 |
| DE | 202010012449 | | 12/2010 |
| DE | 10 2009 032 399 | A1 | 1/2011 |
| DE | 102009032399 | A1 | 1/2011 |
| DE | 102009053449 | | 2/2011 |
| DE | 102010060086 | | 4/2012 |
| DE | 10 2010 056 263 | A1 | 6/2012 |
| DE | 102010056263 | A1 | 6/2012 |
| DE | 102011106060 | | 1/2013 |
| DE | 102011118120 | | 5/2013 |
| DE | 10 2011120 717 | A1 | 6/2013 |
| DE | 112007001824 | B4 | 7/2013 |
| DE | 10 2012 013 464 | A1 | 11/2013 |
| DE | 10 2015 114202 | A1 | 1/2017 |
| DE | 10 2018 118 737 | A1 | 2/2020 |
| DE | 10 2018 118737 | A1 | 2/2020 |
| EM | 002066910-0001 | | 3/2013 |
| EM | 002066910-0002 | | 3/2013 |
| EM | 002066910-0003 | | 3/2013 |
| EM | 002066910-0004 | | 3/2013 |
| EM | 002066910-0005 | | 3/2013 |
| EM | 002066910-0006 | | 3/2013 |
| EM | 002066910-0007 | | 3/2013 |
| EM | 002066910-0008 | | 3/2013 |
| EM | 002066910-0009 | | 3/2013 |
| EM | 002066910-0010 | | 3/2013 |
| EP | 0092043 | A2 | 10/1983 |
| EP | 0092392 | | 10/1983 |
| EP | 0114064 | A2 | 7/1984 |
| EP | 0313958 | A2 | 5/1989 |
| EP | 524408 | | 1/1993 |
| EP | 567325 | | 10/1993 |
| EP | 0631821 | | 1/1995 |
| EP | 0650766 | | 5/1995 |
| EP | 0650766 | A2 | 5/1995 |
| EP | 678334 | | 10/1995 |
| EP | 0706832 | | 4/1996 |
| EP | 0706832 | A1 | 4/1996 |
| EP | 0710506 | | 5/1996 |
| EP | 801002 | | 10/1997 |
| EP | 0846498 | A1 | 6/1998 |

(56) References Cited

FOREIGN PATENT DOCUMENTS

| | | | |
|---|---|---|---|
| EP | 987060 | | 3/2000 |
| EP | 1081639 | | 3/2001 |
| EP | 1106262 | | 6/2001 |
| EP | 1 247 586 | | 10/2002 |
| EP | 1247586 | | 10/2002 |
| EP | 1277519 | | 1/2003 |
| EP | 1294490 | | 3/2003 |
| EP | 1299194 | | 4/2003 |
| EP | 1366823 | | 12/2003 |
| EP | 1412669 | | 4/2004 |
| EP | 1424135 | | 6/2004 |
| EP | 1477232 | A1 | 11/2004 |
| EP | 1479447 | A1 | 11/2004 |
| EP | 1504823 | A1 | 2/2005 |
| EP | 1563913 | | 8/2005 |
| EP | 1574262 | | 9/2005 |
| EP | 1602412 | | 12/2005 |
| EP | 1658902 | A1 | 5/2006 |
| EP | 1708822 | | 10/2006 |
| EP | 1708823 | | 10/2006 |
| EP | 1718415 | | 11/2006 |
| EP | 1880771 | A1 | 1/2008 |
| EP | 1902766 | A1 | 3/2008 |
| EP | 1902786 | | 3/2008 |
| EP | 1902876 | | 3/2008 |
| EP | 1930084 | | 6/2008 |
| EP | 1964616 | | 9/2008 |
| EP | 1964616 | A2 | 9/2008 |
| EP | 1987886 | A2 | 11/2008 |
| EP | 1997561 | A2 | 12/2008 |
| EP | 2017010 | A2 | 1/2009 |
| EP | 2027931 | | 2/2009 |
| EP | 2092987 | A1 | 8/2009 |
| EP | 2106298 | | 10/2009 |
| EP | 2111920 | | 10/2009 |
| EP | 2127758 | A1 | 12/2009 |
| EP | 2451586 | A1 | 5/2012 |
| EP | 2490819 | | 8/2012 |
| EP | 2576079 | | 4/2013 |
| EP | 2608890 | | 7/2013 |
| EP | 2 669 213 | A1 | 12/2013 |
| EP | 2703089 | A1 | 3/2014 |
| EP | 2736651 | B1 | 6/2014 |
| EP | 2 828 000 | A | 1/2015 |
| EP | 2 828 000 | A1 | 1/2015 |
| EP | 3184177 | A1 | 6/2017 |
| EP | 2828000 | B1 | 8/2019 |
| FR | 398333 | | 6/1909 |
| FR | 789762 | | 11/1935 |
| FR | 1410519 | | 9/1964 |
| FR | 2444501 | | 7/1980 |
| FR | 2462200 | A1 | 2/1981 |
| FR | 2 570 140 | | 3/1986 |
| FR | 2 774 928 | | 8/1999 |
| FR | 2863512 | A1 | 6/2005 |
| FR | 2927824 | A1 | 8/2009 |
| GB | 190900523 | | 6/1909 |
| GB | 657854 | A | 9/1951 |
| GB | 2 132 916 | | 7/1984 |
| GB | 2153260 | | 8/1985 |
| GB | 2372465 | | 8/2002 |
| GB | 2411235 | | 8/2005 |
| GB | 2416141 | A | 1/2006 |
| GB | 2444909 | A | 6/2008 |
| HK | 1100405 | | 6/2009 |
| HK | 1096057 | | 7/2009 |
| HK | 1125067 | | 8/2012 |
| HK | 1138533 | | 11/2012 |
| JP | S49-136868 | U | 11/1974 |
| JP | S55-107258 | U | 7/1980 |
| JP | S5654328 | | 5/1981 |
| JP | S57-75246 | | 5/1982 |
| JP | S57128346 | A | 8/1982 |
| JP | 58-119862 | | 5/1983 |
| JP | S5998757 | | 6/1984 |
| JP | S601722 | | 1/1985 |
| JP | S62160156 | A | 7/1987 |
| JP | H01-87805 | | 6/1989 |
| JP | H02258076 | A | 10/1990 |
| JP | H04-176352 | A | 6/1992 |
| JP | H0530749 | | 4/1993 |
| JP | H05172678 | | 7/1993 |
| JP | 674850 | | 3/1994 |
| JP | H06215741 | | 8/1994 |
| JP | H07204542 | A | 8/1995 |
| JP | H08196950 | | 8/1996 |
| JP | H08196950 | A | 8/1996 |
| JP | H09117697 | | 5/1997 |
| JP | 11-047643 | A | 2/1999 |
| JP | 2000015150 | A | 1/2000 |
| JP | 2000070780 | A | 3/2000 |
| JP | 2001259487 | | 9/2001 |
| JP | 2003042882 | | 2/2002 |
| JP | 2003088780 | | 3/2003 |
| JP | 2004-501763 | A | 1/2004 |
| JP | 2004017044 | | 1/2004 |
| JP | 2005000735 | A | 1/2005 |
| JP | 2005138885 | | 6/2005 |
| JP | 2007516831 | | 6/2007 |
| JP | 2008018296 | A | 1/2008 |
| JP | 2008161789 | A | 7/2008 |
| JP | 2010-528837 | A | 8/2010 |
| JP | 2014124274 | A | 7/2014 |
| KR | 2014 0064644 | A | 5/2014 |
| KR | 20140064644 | A | 5/2014 |
| RU | 2523816 | C1 | 1/2014 |
| TW | 491092 | | 6/2002 |
| TW | 510253 | U | 11/2002 |
| TW | I220392 | | 8/2004 |
| TW | I303587 | | 12/2008 |
| TW | I309584 | | 5/2009 |
| WO | 90/008456 | | 8/1990 |
| WO | 91/16610 | | 10/1991 |
| WO | 1992/07346 | | 4/1992 |
| WO | 9522409 | | 8/1995 |
| WO | 1998/32539 | | 7/1998 |
| WO | 01/012337 | | 2/2001 |
| WO | 2001/12337 | | 2/2001 |
| WO | 0166261 | | 9/2001 |
| WO | 01/099062 | | 12/2001 |
| WO | 02/000355 | | 1/2002 |
| WO | 0202242 | | 1/2002 |
| WO | 02/018061 | | 3/2002 |
| WO | 02/085533 | | 10/2002 |
| WO | 03/007252 | | 1/2003 |
| WO | 03/045575 | | 6/2003 |
| WO | 03/069208 | | 8/2003 |
| WO | 03069208 | A1 | 8/2003 |
| WO | 03/086654 | A1 | 10/2003 |
| WO | 04/037433 | | 5/2004 |
| WO | 2004/37433 | | 5/2004 |
| WO | 04/052552 | | 6/2004 |
| WO | 05/018815 | | 3/2005 |
| WO | 05/068220 | | 7/2005 |
| WO | 05/070557 | | 8/2005 |
| WO | 05/070558 | | 8/2005 |
| WO | 05/077543 | | 8/2005 |
| WO | 05/115631 | | 12/2005 |
| WO | 2006065850 | | 6/2006 |
| WO | 07/128127 | | 11/2007 |
| WO | 2007133386 | A2 | 11/2007 |
| WO | 2007/149760 | A2 | 12/2007 |
| WO | 2008/093866 | A1 | 8/2008 |
| WO | 2009015260 | | 1/2009 |
| WO | 2009015260 | A2 | 1/2009 |
| WO | 2009/054986 | A1 | 4/2009 |
| WO | 2009056424 | | 5/2009 |
| WO | 2010019274 | A1 | 2/2010 |
| WO | 2010/044864 | A1 | 4/2010 |
| WO | 2011047876 | | 4/2011 |
| WO | 2011147555 | | 12/2011 |
| WO | 2012/013574 | A1 | 2/2012 |
| WO | 2012/052255 | A1 | 4/2012 |
| WO | 2012119664 | | 9/2012 |

(56) References Cited

FOREIGN PATENT DOCUMENTS

| | | | |
|---|---|---|---|
| WO | 2013000524 | | 1/2013 |
| WO | 2013016474 | | 1/2013 |
| WO | 2013/131626 | A1 | 9/2013 |
| WO | 2013/142045 | A1 | 9/2013 |
| WO | 2014/006593 | A1 | 1/2014 |
| WO | 2015/125619 | A1 | 8/2015 |
| WO | 2016/127106 | A1 | 8/2016 |
| WO | 2016/188804 | A1 | 12/2016 |
| WO | 2017/096740 | A1 | 6/2017 |
| WO | 2018/197025 | A1 | 10/2017 |
| WO | 2020/053153 | A | 3/2020 |
| WO | 2020/0053153 | A1 | 3/2020 |
| WO | 2020/086977 | A1 | 4/2020 |

OTHER PUBLICATIONS

Office Action, dated Jan. 15, 2019, for U.S. Appl. No. 15/679,461.
Response to Election of Species Requirement and Amendment filed Oct. 15, 2018 from U.S. Appl. No. 15/679,482.
Chinese Search Report dated Jul. 18, 2018 for Application No. 2014103745834 filed Jul. 31, 2014.
DesignView of CN302452159 registered Jun. 5, 2013, printed Oct. 18, 2018.
German Search Report dated May 26, 2021, for DE 10 2020 123 769.3 (with machine translation).
Response to Office Action dated Mar. 9, 2020 for U.S. Appl. No. 14/815,210.
Notice of Allowance for U.S. Appl. No. 14/815,210 dated Mar. 25, 2020.
Office Action of U.S. Appl. No. 15/679,461 dated Mar. 31, 2020.
Response to Restriction Requirement filed Jul. 27, 2015 to Restriction Requirement dated May 27, 2015 for U.S. Appl. No. 13/991,285.
Application filed Jul. 31, 2015 for U.S. Appl. No. 14/815,210.
Final Office Action dated Aug. 4, 2015 for U.S. Appl. No. 13/380,949.
Notice of Allowance dated Aug. 3, 2015 for U.S. Appl. No. 29/486,232.
European Search Report, dated Jan. 20, 2020, for European Application No. 19/183,380.
International Search Report (dated Jun. 20, 2008), Written Opinion (dated Jun. 20, 2008), and International Preliminary Report on Patentability (dated Sep. 14, 2010) from PCT/US2008/03318 filed Mar. 12, 2008.
Response filed Dec. 7, 2015 to Office Action dated Aug. 7, 2015 for U.S. Appl. No. 13/991,285.
International Search Report dated Nov. 13, 2019 for PCT/EP2019/074000, filed Sep. 9, 2019.
Written Opinion or PCT/EP2019/074000, filed Sep. 9, 2019.
International Preliminary Report on Patentability with Written Opinion for PCT/EP2019/074000, filed Sep. 9, 2019 (English translation) (7 pages).
Final Office Action dated Nov. 23, 2021 for U.S. Appl. No. 15/679,533.
Office Action dated Feb. 19, 2016 for U.S. Appl. No. 14/113,649.
Final Office Action dated Feb. 25, 2016 for U.S. Appl. No. 13/698,417.
Restriction Requirement dated Mar. 25, 2016 for Design U.S. Appl. No. 29/516,082.
Response filed Mar. 31, 2016 to Office Action dated Dec. 31, 2016 for U.S. Appl. No. 14/572,998.
Response to Final Office Action and RCE dated Nov. 29, 2016 in U.S. Appl. No. 14/113,649.
Response restriction requirement filed May 23, 2016 for Design U.S. Appl. No. 29/516,082.
Examination Report from the European Patent Office dated Nov. 23, 2021 for European Patent Application No. 19183380.5.
Office Action dated Dec. 9, 2021 for U.S. Appl. No. 16/524,838.
May. 22, 2018 Final Office Action for U.S. Appl. No. 14/113,649.
Jun. 25, 2018 Response to Office Action for U.S. Appl. No. 14/815,210.
For U.S. Appl. No. 15/679,533: Interview Summary dated Jun. 17, 2020 Response to Office Action, filed Jun. 30, 2020.
Office Action dated Jun. 12, 2020, for U.S. Appl. No. 15/575,549.
International Search Report and Written Opinion for PCT/EP2021/54059, filed Feb. 18, 2021.
Chinese Search Report for Application No. 2017107135569 dated Aug. 24, 2020 and English translation.
Office Action dated Dec. 31, 2015 for U.S. Appl. No. 14/572,998.
Notice of Allowance dated Jan. 19, 2016 for Design U.S. Appl. No. 29/539,615.
Notice of Allowance dated Jan. 22, 2016 for U.S. Appl. No. 13/991,285.
International Preliminary Report on Patentability with Written Opinion dated Mar. 9, 2021 for PCT/EP2019/074000 filed Sep. 9, 2019.
Response to Office Action dated Apr. 5, 2019 for U.S. Appl. No. 15/679,461 (29 pages).
Response to Office Action dated Apr. 9, 2019 for U.S. Appl. No. 15/679,533 (22 pages).
Notification of the First Office Action with search report dated Aug. 24, 2015 for Chinese Application No. 201280020519.5 (related to U.S. Appl. No. 14/113,649), 13 pages.
Notification of the Second Office Action dated May 16, 2016, for Chinese Application No. 201280020519.5 (related to U.S. Appl. No. 14/113,649), 5 pages.
Japanese Office Action for JP2014-517485 (related to U.S. Appl. No. 14/113,649), dated Jul. 5, 2016, 16 pages.
Search Report dated Jan. 26, 2022, for Chinese Patent Appl. No. 2019107032612 with translation.
Office Action dated Aug. 7, 2015 for U.S. Appl. No. 13/991,285.
Final Office Action dated Sep. 4, 2020 for U.S. Appl. No. 15/679,533.
Japanese Office Action dated Sep. 25, 2019 for Japanese Publication No. 2015-149405, 4 pages.
International Preliminary Report on Patentability dated Sep. 6, 2022 with Written Opinion for PCT/EP2021/053940 (English Translation).
International Preliminary Report on Patentability dated Sep. 6, 2022 with Written Opinion for PCT/EP2021/054059 (English Translation).
International Preliminary Report on Patentability dated Sep. 6, 2022 with Written Opinion for PCT/EP2021/054061 (English Translation).
Written Opinion dated Sep. 8, 2016 for International Application No. PCT/EP2016/061057 filed May 18, 2016.
Notice of Allowance dated Sep. 17, 2020 for U.S. Appl. No. 15/679,461.
Second Chinese Office Action dated Jun. 24, 2015 for Chinese Application No. 2011800266029.
Third Chinese Office Action dated Nov. 30, 2015 for Chinese Application No. 2011800266029.
Final Office Action dated Aug. 29, 2016 for U.S. Appl. No. 14/113,649.
Office Action dated Nov. 2, 2016 for U.S. Appl. No. 11/949,122.
European Search Report dated May 8, 2017 for Application No. EP16203544.
"Spray Guns/sata.com", Oct. 18, 2015, XP055364928 URL:http://web.archive.org/web/20151018205307/http://www.sata.com/index.php?id=lackierpistolen&L=11 [gefunden am Apr. 13, 2017]; reprinted on Dec. 8, 2017.
"SATAjet 5000 B Lackierpistolen | Bechersysteme | Atemschutz | Filtertechnik | Zubehor So flexibel wie Ihre Aufgaben" Apr. 11, 2017, XP055364477 Gefunden im Internet: URL:https/www.sata.com/uploads/tx_pxspecialcontent/00_SATAjet_5000_B.pdf [gefunden am Apr. 12, 2017]; English translation of full brochure attached.
Amendments submitted to European Patent Office dated Dec. 3, 2017 for Application No. EP16203544 (with English translation of chart on p. 3).
Response filed May 28, 2019 for U.S. Appl. No. 15,379,972 (144).
Final Office Action for U.S. Appl. No. 15/679,461 dated Jun. 11, 2019.
Final Office Action for U.S. Appl. No. 15/679,533 dated Jul. 12, 2019.
International Search Report and Written Opinion for PCT/EP2021/53940, filed Feb. 18, 2021.

(56) References Cited

OTHER PUBLICATIONS

For U.S. Appl. No. 16/524,838: Response and Request for Continued Exam filed Oct. 22, 2021.
German Search Report dated May 7, 2019 for Application No. 10 2018 122 004.9.
Office Action dated Feb. 5, 2021 for U.S. Appl. No. 16/524,740.
Office Action dated Feb. 5, 2021 for U.S. Appl. No. 16/524,838.
Response to Final Office Action, dated Nov. 11, 2019, for U.S. Appl. No. 14/815,210 20 pages.
Office Action, dated Nov. 20, 2019, for U.S. Appl. No. 15/575,549 12 pages.
Office Action, dated Dec. 9, 2019, for U.S. Appl. No. 14/815,210 6 pages.
Final Office Action dated Feb. 27, 2020 for U.S. Appl. No. 15/575,549.
Office Action dated Nov. 24, 2021 for U.S. Appl. No. 16/524,740.
Office Action dated Jan. 25, 2019 for U.S. Appl. No. 15/379,972.
Final Rejection dated Jul. 22, 2021 for U.S. Appl. No. 16/524,838.
Restriction/Species requirement dated Dec. 7, 2020 for U.S. Appl. No. 16/524,838.
Response to Office Action filed Feb. 16, 2016 for U.S. Appl. No. 13/698,417.
Screen shot of a SATA product (SATAjet B) description retrieved on Feb. 12, 2016 from www.sata.com/index.php.
"The Hot Rolling Process;" California Steel; retrieved on Feb. 12, 2016 from http://www.californiasteel.com/GetPublicFile.aspx?id=53.
For Chinese Application No. 201910704447.X: Search Report, dated Aug. 25, 2022 Second Office Action, dated Sep. 1, 2022.
Office Action from U.S. Appl. No. 15/143,698 dated Jan. 5, 2017.
German Search Report for German Application No. 10 2015 016 474.0 dated Aug. 9, 2016, 14 pages.
Notice of Allowance in U.S. Appl. No. 29/556,463, filed Mar. 1, 2016, 9 pages.
Notice of Allowance in U.S. Appl. No. 29/555,656, filed Feb. 24, 2016, 5 pages.
Final Office Action dated Dec. 7, 2017 for U.S. Appl. No. 14/815,210.
Response filed Oct. 6, 2015 to Notice of Non-Compliant Amendment for U.S. Appl. No. 13/698,417.
Notice of Non-Compliant Amendment dated Aug. 10, 2015 for U.S. Appl. No. 13/698,417.
Final Office Action dated Oct. 16, 2015 for U.S. Appl. No. 13/698,417.
Extended European Search Report dated Apr. 17, 2015 for European Application No. 14004167.4.
Canadian Office Action dated Nov. 21, 2012 for related application CA2741703.
Chinese Search Report dated Dec. 5, 2012 for related application CN200980135429.9.
Chinese Office Action dated Dec. 13, 2012 for related application CN200980135429.9.
German Search Report for DE 20 2008 014 389.6 completed Jul. 13, 2009.
International Preliminary Report on Patentability for PCT/EP2015/001728 filed Aug. 25, 2015.
Final Office Action dated Mar. 16, 2017 from U.S. Appl. No. 13/698,417, 9 pages.
Notice of Allowance dated Jul. 26, 2021 for U.S. Appl. No. 15/575,549.
Office Action dated Jun. 30, 2017 for U.S. Appl. No. 14/815,210.
Examination Report from the European Patent Office dated Nov. 8, 2021 for European Patent Application No. 19183382.1.
Office Action dated Dec. 2, 2022 for U.S. Appl. No. 16/524,838.
Office Action dated Mar. 30, 2020, for U.S. Appl. No. 15/679,533.
Restriction Requirement Office Action dated Aug. 28, 2018 in U.S. Appl. No. 15/679,533.
Restriction Requirement Office Action dated Aug. 28, 2018 in U.S. Appl. No. 15/679,461.
Notice of Allowance dated Sep. 14, 2018 in U.S. Appl. No. 29/618,945.
Notice of Allowance dated Sep. 14, 2018 in U.S. Appl. No. 14/113,649.
Final Office Action dated Sep. 12, 2018 in U.S. Appl. No. 14/815,210.
European Search Report dated Jan. 24, 2018 for U.S. Appl. No. 17/186,905.
International Search Report and Written Opinion for PCT/EP2021/054061, filed Apr. 16, 2021.
Zhu Zhifu, "Simulation and Experimental Study on Spray Characteristics of Gas-Assisted Urea Spray Gun", Aug. 6, 2019, pp. 1-6.
Printout from Internet www.ehow.com explaining how to choose a spray gun and stating in item 2 "Nozzle sizes vary between about 1 mm and 2 mm.", printed Sep. 7, 2012 (Exhibit 1023 in IPR 2013-0111).
Printout from Internet www.bodyshopbusiness.com explaining how to choose nozzle setup in paragraph bridging pp. 1 and 2, giving general rule of thumb of nozzle sizes from 1.3 mm to 2.2 mm, depending on material being sprayed, printed Sep. 7, 12 (Exhibit 1024 in IPR 2013-0111).
Printout from Internet of pages from brochure of Walther Pilot showing nozzle sizes for spray guns ranging from 0.3 mm to 2.5 mm, dated 2007, (Exhibit 1025 in IPR 2013-0111).
Printout from Internet www.alsacorp.com showing in the paragraph bridging pp. 2 and 3, Model VS-7200 Saber LVLP spray gun with nozzle size 1.3 mm with sizes 1.3 to 2.0 available, printed Aug. 26, 2012 (Exhibit 1026 in IPR 2013-0111).
Printout from Internet of copy of p. 28 from current 3Mtm brochure showing Tip/Nozzle/Air Cap Selection Guide with nozzle sizes from 0.5 mm to 3.0 mm., (Exhibit 1027 in IPR 2013-0111).
Decision by EPO regarding opposition proceedings to revoke patent No. 99926841.0-2425/ 1108476, corresponding to '387 patent, 2012, (Exhibit 1029 in IPR 2013-0111).
SATA News Publication Dan-Am Jul.-Sep. 1996, (Exhibit 1034 in IPR 2013-0111).
SATA News Publication Dan-Am Oct.-Dec. 1996, (Exhibit 1035 in IPR 2013-0111).
SATA News Publication Dan-Am Apr.-Jun. 1998 (Exhibit 1036 in IPR 2013-0111).
Dan-Am SATA Catalog 6 for spray guns 1991 (Exhibit 1037 in IPR 2013-0111).
Dan-Am SATA Catalog 8 for spray guns 1994 (Exhibit 1038 in IPR 2013-0111).
Dan-Am Catalog 6—51pp published 1991, (Exhibit 1042 in IPR 2013-0111).
Japanese Industrial Standards B 9809 English translation, 1992 (Exhibit 1049 in IPR 2013-0111).
Japanese Industrial Standards B 9809 revised Mar. 1, 1991 (Exhibit 1050 in IPR 2013-0111).
SATA News, vol. 21, 2009 (Exhibit 2010 in IPR 2013-0111).
Collision Hub TV Document (image from video clip) printed Oct. 9, 2013 (Exhibit 2011 in IPR 2013-0111).
MyRielsMe.com document from press release printed Oct. 9, 2013 (Exhibit 2012 in IPR 2013-0111).
How to set Air pressure, Utube screenshot printed Oct. 9, 2013 (Exhibit 2013 in IPR 2013-0111).
Ohio EPA Letty to Tony Larimer, response to letter dated Aug. 2006 (Exhibit 2014 in IPR 2013-0111).
Pinahs Ben-Tzvi et al, A conceptual design . . . , Mechatrronics 17 (2007) p. 1-13 (Exhibit 2015 in IPR 2013-0111).
On line ad from Amazon.com printed Oct. 14, 2013 (Exhibit 2017 in IPR 2013-0111).
Rone et al., MEMS-Baed Microdroplet Generation with Integrated Sensing, COMSOL, 2011 (Exhibit 2018 in IPR 2013-0111).
Response filed Dec. 21, 2015 to Office Action dated Jul. 20, 2015 for U.S. Appl. No. 14/113,649.
European Search Report dated Feb. 4, 2022 for Application No. 21191428.8.
Search Report dated Jan. 7, 2022, for Chinese Patent Appl. No. 2018800961965, with translation.
Office Action dated Apr. 26, 2022 for U.S. Appl. No. 15/679,533.
International Search Report dated Apr. 12, 2019 for PCT/DE2018/100679 filed Aug. 1, 2018.
Written Opinion for PCT/DE2018/100679 filed Aug. 1, 2018.
Restriction Requirement dated Mar. 18, 2019, for U.S. Appl. No. 29/596,869.
Office Action dated Mar. 15, 2019, for U.S. Appl. No. 14/815,210.

(56) References Cited

OTHER PUBLICATIONS

U.S. Appl. No. 14/815,210 Office Action dated Apr. 3, 2018.
U.S. Appl. No. 14/113,649 Response filed Mar. 3, 2018.
German Search Report dated Apr. 10, 2018 for Application No. 10 2017 118 599.2.
Response to Office Action dated Jun. 25, 2018 for U.S. Appl. No. 14/815,210.
Response to Final Office Action dated Aug. 22, 2018 for U.S. Appl. No. 14/113,649.
RCE Reply filed Oct. 11, 2019 for U.S. Appl. No. 15/679,461.
For Chinese Patent Application No. 2019800593031: First Office Action dated Apr. 25, 2022 (Eng. translation) Chinese Search Report dated Apr. 19, 2022.
Office Action, dated Jan. 9, 2019, for U.S. Appl. No. 15/679,482.
Search Report dated Jan. 29, 2022, for Chinese Patent Appl. No. 201910704447X, with translation.
Final Office Action dated May 2, 2022 for U.S. Appl. No. 16/524,740.
International Search Report dated Apr. 12, 2019 and Written Opinion for PCT/DE18/100679, filed Aug. 1, 2018 (21 pages).
Final Office Action dated Jun. 1, 2021 for U.S. Appl. No. 16/524,740.
German Search Report for Application No. 10 2016 009 957.7 dated Apr. 21, 2017.
Notice of Allowance dated Jan. 27, 2016 for Design U.S. Appl. No. 29/510,723.
Office Action dated Nov. 18, 2014 for U.S. Appl. No. 14/113,649.
Notice of Allowance dated Nov. 19, 2014 for U.S. Appl. No. 29/486,223.
Office Action dated Dec. 31, 2014 for U.S. Appl. No. 13/380,949.
Restriction Requirement dated Jan. 9, 2015 for Design U.S. Appl. No. 29/469,049.
Response to Office Action filed Dec. 2, 2014 for U.S. Appl. No. 29/487,679.
Notice of Allowance dated Jan. 15, 2015 for Design U.S. Appl. No. 29/490,620.
Office Action dated Jan. 14, 2015 for Design U.S. Appl. No. 29/447,887.
Hercules Paint Gun Washers brochure publish date Jan. 2012, [online], [site visited Jan. 7, 2015], <http://www.herkules.us/pdfs/L00761-Hercules-Gun_Washers-4-page-brochure.pdf>.
Jetclean GUn Cleaner Terry's Auto Supply, google publish date Aug. 4, 2011, [online]. [site visited Jan. 7, 2015], <http:// secure.terrys.net/viewProduct.php?productID=FT.FHAZ1005>.
Restriction Requirement dated Feb. 6. 2015 for Design U.S. Appl. No. 29/486,232.
Office Action dated Mar. 30, 2015 for U.S. Appl. No. 13/698,417.
Responde to Office Action filed Apr. 14, 2015 to Office Action dated Jan. 14, 2015 for U.S. Appl. No. 29/447,887.
Response filed Jul. 20, 2015 for Office Action dated Mar. 30, 2015 for U.S. Appl. No. 13/698,417.
Notice of Allowance dated Apr. 30. 2015 for U.S. Appl. No. 29/447,887.
Chinese Office Action dated Oct. 28, 2014 and Search Report dated Oct. 15, 2014 for Chinese Application No. 2011800266029.
Australian Examination Report dated Oct. 30, 2012 for Australian Application No. 2010268870.
Notice of Allowance dated Apr. 24, 2015 for Design U.S. Appl. No. 29/486,232.
Restriction Requirement dated Jan. 22, 2015 for U.S. Appl. No. 13/698,417.
Response filed Mar. 23, 2015 to Restriction Requirement dated Jan. 22, 2015 for U.S. Appl. No. 13/698,417.
Response filed Apr. 6, 2015 to Office Action dated Feb. 8, 2015 for Design U.S. Appl. No. 29/486,232.
Response filed Mar. 31, 2015 to Office Action dated Dec. 31, 2014 for U.S. Appl. No. No. 13/380,949.
Japanese Office Action dated Jun. 11, 2014 for Japanese Patent Application No. 2012-518769.
Australian Examination Report dated Nov. 11, 2014 for Australian patent Application No. 2011257605.
Japanese Notice of Allowance dated Jan. 13, 2015 for Japanese Patent Application No. 2012/518769.
Application filed Dec. 11, 2011 for U.S. Appl. No. 13/380,949.
Chinese Office Action dated Jan. 28, 2014 and Search Report dated Jan. 21, 2014 for Chinese Application No. 201080030935.4.
Search Report dated Apr. 24, 2010 for German Application No. 10 2009 032 399.6-51.
Application filed Oct. 24, 2013 for U.S. Appl. No. 14/113,649.
Response filed May 18, 2015 to Office Action dated Nov. 18, 2014 for U.S. Appl. No. 14/113,649.
Application filed Dec. 17, 2014 for U.S. Appl. No. 14/572,998.
German Search Report dated Mar. 25. 2014 for German Application No. 202013105779-7.
Application filed Nov. 16, 2012 for U.S. Appl. No. 13/698,417.
Application filed Jun. 2, 2013 for U.S. Appl. No. 13/991,285.
English translation of application filed Aug. 13, 2013 for Application filed Jun. 2, 2013 for U.S. Appl. No. 13/991,285.
Restriction Requirement dated May 27, 2015 for U.S. Appl. No. 13/991,285.
Application filed Jan. 29, 2015 for Design U.S. Appl. No. 29/516,073.
Application filed Jan. 29, 2015 for Design U.S. Appl. No. 29/516,082.
Application filed Mar. 3, 2015, 2015 for Design U.S. Appl. No. 29/519,196.
Final Office Action dated Jul. 20, 2015 for U.S. Appl. No. 14/113,649.
International Search Report dated Aug. 31, 2016 for PCT/EP2016/061057 filed May 18, 2016.
Written Opinion for PCT/EP2016/061057 filed May 18, 2016.
Response to Final Office Action, filed Jan. 4, 2021, for U.S. Appl. No. 15/679,533 (18 pages).
Response to Restriction Requirement, filed Jan. 25, 2021, for U.S. Appl. No. 16/524,740 (9 pages).
Final Office Action in U.S. Appl. No. 14/113,649 dated Jun. 22, 2017.
Response filed in U.S. Appl. No. 15/143,698 dated Jul. 3, 2017.
Response filed May 5, 2021 for U.S. Appl. No. 16/524,740.
Response filed May 5, 2021 for U.S. Appl. No. 16/524,838.
International Preliminary Report on Patentability dated Feb. 2, 2021 and Written Opinion for PCT/DE2018/100679 filed Aug. 1, 2018 (English Translation).
Notice of Allowance dated May 18, 2021 for U.S. Appl. No. 29/730,873.
Anonymous: "DeVilbiss Automotive RefinishingSpray Gun Setup", Jan. 27, 2015 (Jan. 27, 2015), XP055580418, retrieved from the Internet: URLhttps:/ /web.archive.org/web/20150127025402lhttp://www.autorefinishdevilbiss.com.spray-gun-setup.aspx.
Anonymous: "DeVilbiss—Spray Gun Tool on the AppStore", Oct. 19, 2015 (Oct. 19, 2015), XP055580448, retrieved from the Internet: URLhttps://itunes .apple.comlus/app/ devilbiss-spray-gun-tool/id590404917?mt=8.
For U.S. Appl. No. 16/524,740: Interview Summary and Advisory Action dated Aug. 30, 2021.
Office Action dated Feb. 19, 2021 for U.S. Appl. No. 15/575,549.
European Search Report dated Feb. 21, 2020 for Application No. 19183382.1.
Response dated Feb. 19, 2020 for U.S. Appl. No. 15/575,549.
Final Office Action dated Sep. 23, 2020, for U.S. Appl. No. 15/575,549.
Response to Restriction Requirement filed in U.S. Appl. No. 14/815,210 dated Jun. 19, 2017.
Notification of the Second Office Action dated Aug. 26, 2022 for Application No. 2019107032612.
International Search Report, Written Opinion and International Preliminary Report on Patentability for PCT/EP2004/005381 file May 19, 2004.
International Search Report, Written Opinion and International Preliminary Report on Patentability for PCT/EP2004/011998 filed Oct. 23, 2004.
International Search Report, Written Opinion and International Preliminary Report on Patentability for PCT/EP2005/000435 filed Jan. 18, 2005.
International Search Report, Written Opinion and International Preliminary Report on Patentability for PCT/EP2005/00437 filed Jan. 18, 2005.

(56) References Cited

OTHER PUBLICATIONS

International Search Report, Written Opinion and International Preliminary Report on Patentability for PCT/EP2008/063344, filed Oct. 6, 2008.
International Search Report, Written Opinion and International Preliminary Report on Patentability for PCT/EP2010/002392 filed Apr. 20, 2010.
International Search Report, Written Opinion and International Preliminary Report on Patentability for PCT/EP2011/002544 filed May 21, 2011.
International Search Report, Written Opinion and International Preliminary Report on Patentability for PCT/EP2011/066665 filed Sep. 26, 2011.
International Search Report, Written Opinion and International Preliminary Report on Patentability for PCT/EP2010/003399 filed Jun. 7, 2010.
International Search Report, Written Opinion and International Preliminary Report on Patentability for PCT/EP2011/5842 filed Dec. 2, 2010.
International Search Report, Written Opinion and International Preliminary Report on Patentability for PCT/EP2012/01939 filed May 5, 2012.
International Search Report, Written Opinion and International Preliminary Report on Patentability for PCT/EP2009/06992 filed Sep. 29, 2009.
Internet Archive Wayback Machine [online] [captured Sep. 25, 2012] [retrieved on Sep. 8, 2014] retrieved from the Internet URL:http://web.archive.org/web/20120925210554/http://www.sata.com/index.php?id=sal-check&no cache=1&L=11.
JP Office Action issued against JP Patent App. 2012-508926 on Feb. 25, 2014 with English translation.
Restriction Requirement Office Action dated Apr. 17, 2017 for U.S. Appl. No. 14/815,210.
Notice of Allowance dated Apr. 10, 2017 for U.S. Appl. No. 29/579,824.
Response to Final Office Action filed May 9, 2017 in U.S. Appl. No. 13/698,417.
Response to Office Action filed May 17, 2017 in U.S. Appl. No. 14/113,649.
Second Office Action, dated Aug. 12, 2022, for Chinese Application No. 2018800961965 (English translation).
Search Report, dated Aug. 1, 2022, or Chinese Application No. 2018800961965.
German Search Report dated Mar. 15, 2016 for Application No. 20 2015 003 664.3, 8 pages.
Chinese Search Report dated Feb. 21, 2019 for Application No. 2016800293781, 3 pages.
Response to Restriction Requirement filed Oct. 29, 2019 for U.S. Appl. No. 15/575,549.
Final Office Action dated May 12, 2022, for U.S. Appl. No. 16/524,838.
Office Action dated Aug. 12, 2021 for U.S. Appl. No. 15/679,533.
International Search Report dated Jul. 14, 2016 for International Application No. PCT/EP2016/000809, filed May 17, 2016.
Written Opinion for International Application No. PCT/EP2016/000809, filed May 17, 2016.
Final Office Action dated Aug. 12, 2019 from U.S. Appl. No. 14/815,210.
Search Report dated Feb. 22, 2019 for German Patent Application No. 10 2018 118 738.6.
Search Report dated Feb. 8, 2019 for German Patent Application No. 10 2018 118 737.8.
Notice of Allowance dated Jul. 1, 2019 for U.S. Appl. No. 15/379,972.
Notice of Allowance dated Jul. 9, 2019 for U.S. Appl. No. 15/679,482.
Notice of Allowance dated Apr. 18, 2016 for U.S. Appl. No. 14/572,998.
Response filed Apr. 27, 2016 to Office Action dated Jan. 29, 2016 for U.S. Appl. No. 13/380,949.
German Search Report dated Apr. 12, 2016 for related German Application No. 10 2015 008 735.5.
Decision on Rejection dated Feb. 10, 2023 for Chinese Patent Application No. 2018800961965.
Search Report dated Jan. 30, 2023 for Chinese Patent Application No. 2018800961965.
Third Office Action dated Feb. 15, 2023 for Chinese Patent Application No. 20191070444.X.
Office Action dated Feb. 24, 2023 for U.S. Appl. No. 16/524,740.
Chinese Notification of the Third Office Action dated Feb. 14, 2023 for Chinese Patent Application No. 2019107032612, 15 pages.
European Office Action dated Mar. 21, 2023 for European Patent Application No. 19 183 382.1, 12 pages.
German Search Report dated Apr. 21, 2017 for application No. 10 2016 009 957.7.

* cited by examiner

| | HVLP | | | | | Compliant | | | | |
|---|---|---|---|---|---|---|---|---|---|---|
| Nozzle Size | 1,1 | 1,2 | 1,3 | 1,4 | 1,5 | 1,1 | 1,2 | 1,3 | 1,4 | 1,5 |
| Jet Shape (10) |  | | | | | | | | | |
| Spray Jet Section Height [%] | 100 | 100 | 100 | 100 | 100 | 115 | 115 | 115 | 115 | 115 |
| Spray Jet Section Width [%] | 100 | 100 | 100 | 100 | 100 | 100 | 100 | 100 | 100 | 100 |
| Medium Flow Rate [g/min] | 135 | 150 | 165 | 180 | 195 | 155 | 170 | 185 | 200 | 215 |
| Jet Shape (20) |  | | | | | | | | | |
| Spray Jet Section Height [%] | 106 | 106 | 106 | 106 | 106 | 120 | 120 | 120 | 120 | 120 |
| Spray Jet Section Width [%] | 88 | 88 | 88 | 88 | 88 | 88 | 88 | 88 | 88 | 88 |
| Medium Flow Rate [g/min] | 135 | 150 | 165 | 180 | 195 | 155 | 170 | 185 | 200 | 215 |

30

40

SET OF NOZZLES FOR A SPRAY GUN, SPRAY GUN SYSTEM, METHOD FOR EMBODYING A NOZZLE MODULE, METHOD FOR SELECTING A NOZZLE MODULE FROM A SET OF NOZZLES FOR A PAINT JOB, SELECTION SYSTEM AND COMPUTER PROGRAM PRODUCT

FIELD OF THE INVENTION

The present invention relates to a set of nozzles for a spray gun, especially a compressed-air atomizing paint spray gun, a spray gun system, a method for embodying a nozzle module, a method for selecting a nozzle module from set of nozzles for a paint job, a selection system, especially a "slide gate system," and a computer program product.

BACKGROUND

According to the prior art, spray gun, especially a paint spray gun, in particular a compressed-air atomizing paint spray gun which is also referred to as compressed-air atomizing paint gun, comprises a spray medium nozzle disposed on the head thereof, which is also known as a paint nozzle and which is screwed into the gun body. On its front end, the spray medium nozzle frequently has a small hollow-cylindrical peg, i.e., a substantially hollow-cylindrical front section, from the front muzzle, i.e., from the spray medium outlet of which the medium to be sprayed exits during operation. However, the front portion of the spray medium nozzle can also have a conical shape. As a rule, the head of the gun has an external thread, by means of which an air nozzle ring with an integrated air cap is screwed onto the head of the gun. The air cap has a central aperture, the diameter of which is larger than the outside diameter of the peg of the spray medium nozzle or the outside diameter of the front end of a conical spray medium nozzle. The central aperture of the air cap and the small peg or the front end of the spray medium nozzle together form an annular gap. Exiting from this annular gap is the so-called atomizing air which, in the above-described nozzle configuration, generates a vacuum on the front face surface of the spray medium nozzle, which causes the medium to be sprayed to be sucked out of the spray medium nozzle. The atomizing air strikes the paint jet, which causes the paint jet to be sheared into strings and ribbons. Due to their hydrodynamic instability, the interaction between the rapidly flowing compressed air and the ambient air, and due to aerodynamic disturbances, these strings and ribbons disintegrate into droplets which are blown away from the nozzle by the atomizing air.

Further, the air cap frequently has two horns which are disposed diametrically opposite to one another and which, in the outflow direction, project beyond the aforementioned annular gap and the spray medium outlet aperture. From the rear surface of the air cap, two supply bores, i.e., horn air inlet channels, extend to horn air outlet apertures in the horns. As a rule, each horn has at least one horn air outlet aperture; preferably, however, each horn has at least two horn air outlet apertures, from which the horn air exits. As a rule, the horn air outlet apertures are oriented such that they point to the longitudinal axis of the nozzle in the exit direction after the annular gap so that the so-called horn air exiting from the horn air outlet apertures is able to influence the air or the paint jet that has already exited from the annular gap or the paint mist which has at least in part already been generated. As a result, the paint jet or spray jet with an originally round cross section (round jet) is compressed along the sides that face the horns and is lengthened in a direction perpendicular thereto. This creates a so-called wide jet which makes it possible to paint large surfaces at a higher speed. In addition to deforming the spray jet, the horn air has the purpose of further atomizing the spray jet.

As a rule, the above-mentioned spray medium nozzle comprises a hollow main section and a substantially hollow-cylindrical front section with an outlet aperture for the spray medium, with the medium to be sprayed flowing through said outlet aperture. Depending on the type of medium to be sprayed and the preference of the user of the spray gun, the spray gun can be fitted with spray medium nozzles having spray medium outlet apertures of different sizes, i.e., spray medium outlet apertures having inside diameters of different sizes. As a rule, if the medium to be sprayed, e.g., paint, is a relatively high-viscosity medium, for example, a filler, a spray medium nozzle having a spray medium outlet aperture with an inside diameter larger than that for a low-viscosity material such as varnish should be used. Generally, the inside diameter of a spray medium outlet aperture of a spray medium nozzle measures between a few tenths of a millimeter and several millimeters. A spray medium nozzle with a spray medium outlet aperture having a defined inside diameter is frequently referred to as a spray medium nozzle having a defined "nozzle size," with the value of this nominal nozzle size not necessarily having to correspond exactly to the value of the inside diameter of the spray medium outlet aperture.

Depending on the nozzle size, i.e., depending on the size of the inside diameter of the spray medium outlet aperture of the spray medium nozzle, the spray medium nozzle or the spray gun fitted with the spray medium nozzle, can have a defined medium flow rate. The medium flow rate is the amount of medium which exits from the spray medium nozzle of the spray gun within a defined period of time at a defined inlet flow pressure and a fully actuated trigger position. The value is given in grams per minute (g/min). With all other parameters remaining the same, the medium flow rate increases with increasing nozzle size, with the medium flow rate being influenced not only by the inside diameter of the spray medium outlet aperture but also by the length of the hollow-cylindrical front section, the configuration of the various surface areas inside the spray medium nozzle, especially by the angles at which the surface areas are arranged relative to each other, and by different embodiments of the spray medium nozzle.

In spray guns according to the prior art, the size of the spray jet generated by the spray gun, especially the height and/or the width of the spray jet or the spray jet section, changes as the medium flow rate increases. The spray jet section can be visualized by means of a so-called spray image. A spray image is generally generated in that, using a spray gun at a defined distance, for example, 15 cm to 20 cm from a substrate, for example, paper, a sheet of scaled paper provided for generating a spray image, or a metal sheet, paint or varnish is applied to this sheet of paper or metal sheet without moving the spray gun. The spraying time measures approximately 1 to 2 seconds. The shape of the spray image thus generated and the size of the droplets on the substrate provide information about the quality of the spray gun, especially about the quality of the nozzles.

The coating thickness of the spray image can be measured by means of the procedures known from the prior art, for example, by means of coating thickness gauges before or after the spray image has dried, or the paint droplets and their size and position are determined while they are still traveling to the substrate, e.g., by means of laser diffraction methods.

A spray image like the one described above does not have a uniform coating thickness across the length and width thereof. The central core of the spray image has a high coating thickness; outside the core, the coating thickness generated is lower. The coating thickness transition from the core to the outer zone is fluid. Plotting the coating thickness across the length of the spray image from left to right results in an initially flat slope which marks the outermost edge of the outer zone. In the vicinity of the core, the coating thickness increases relatively sharply and, in the ideal case, remains substantially constant along the linear extension of the core, i.e., it reaches a plateau. At the edge of the core, the coating thickness drops relatively sharply, followed by a flattening of the curve toward the end of the outer zone. It has been shown that a uniform, higher quality coating can be obtained, the sharper the transition from the core to the outer zone, i.e., the steeper the profile of the coating thickness along the length of the spray image in the transition area from the outer zone into the core zone. During the painting procedure, the painter moves the actuated spray gun in meandering paths, which overlap over approximately between 30% to 50% of their height, i.e., approximately the lower or upper third of a path overlaps the upper or lower third of the preceding path. A more sharply defined core zone allows the painter to coat the core zones of the spraying paths during the painting procedure as contiguously as possible so that a uniform overall coating thickness is obtained. However, in order to avoid the risk of overcoating, e.g., by unintentionally applying twice the coating thickness, which can lead to so-called paint runs, the transition should not be overly abrupt. The tests have also shown that it is beneficial if the above-mentioned plateau is as wide as possible, i.e., if the core zone of the spray image with the maximum coating thickness is as long as possible.

In the case at hand, the spray image is intended to constitute the spray jet section. Hereinafter, whenever the terms spray jet section height, spray jet section width or cross-sectional shape of the spray jet are used, these terms shall be deemed to refer to the height, the width and the shape of the spray image, especially the height, the width and the shape of the core zone of the spray image.

As already mentioned above, in prior-art spray guns, the size of the spray jet generated by the spray gun, especially the height and/or the width of the spray jet or the spray jet section or the spray jet core section changes as the medium flow rate increases. With increasing nozzle size and/or increasing medium flow rate, the spray jet not only becomes "wetter" as desired, i.e., more spray medium per surface area is applied, but the spray jet section increases in height and/or in width. Further, the medium flow rate does not uniformly increase with increasing nozzle size, especially nominal nozzle size. For example, a so-called 1.2 nozzle can have a medium flow rate that is higher by 10 g/min than that of a 1.1 nozzle, but a medium flow rate that is lower by 20 g/min than that of a 1.3 nozzle. Thus, anytime a nozzle is replaced, users of the spray gun must adapt their mode of operation to the new nozzle. For example, if the user wishes to spray a spray medium having a defined viscosity and subsequently a spray medium having a different viscosity and therefore switches from one nozzle size to a different nozzle size, the user will have to adjust, for example, the distance of the spray gun relative to the surface area to be coated or the painting speed, i.e., the speed at which the user moves the spray gun across the surface area to be coated, to the new nozzle. This can complicate the job of the user of the spray gun. In addition, users of prior-art spray guns do not have the option to use a jet shape best suited to them and their mode of operation, i.e., a spray jet section best suited to them.

SUMMARY OF THE INVENTION

Thus, one aspect of the invention relates to a set of nozzles for a spray gun, in particular a compressed-air atomizing paint spray gun, and a spray gun system, which offer the user greater consistency in the painting results.

Another aspect of the present invention relates to an efficient method for embodying a nozzle module.

Another aspect of the present invention relates to an efficient method for selecting a nozzle module.

Yet another aspect of the present invention relates to an efficient selection system, especially a "slide gate system."

An additional aspect of the present invention relates to a functionally reliable computer program product.

Disclosed is a set of nozzles for a spray gun, in particular a compressed-air atomizing paint spray gun, which comprises at least one nozzle module group with at least two, preferable at least four, different nozzle modules for optional mounting in or on one and the same base module of a spray gun, with the nozzle modules being designed such that they have a different medium flow rate under the same spray conditions and with the spray jets generated by means of the nozzle modules having substantially the same spray jet height and the same spray jet section width, in particular, with the spray jet sections of the different nozzle modules being congruent.

The nozzle modules within the nozzle module group each have a different medium flow rate, in particular, the nozzles have different nozzle sizes, especially nominal nozzle sizes. The nozzle module group can comprise, for example, a 1.1 nozzle module, a 1.2 nozzle module, a 1.3 nozzle module, a 1.4 nozzle module and a 1.5 nozzle module, the medium flow rate of which modules increases as the nominal nozzle size increases. The nominal nozzle size can be substantially equivalent to the actual nozzle size, i.e., to the actual inside diameter of the outlet aperture of the paint nozzle of the nozzle module in millimeters. Thus, for example, the inside diameter of the 1.5 nozzle module can measure 1.5 mm. However, the inside diameter of the spray medium outlet aperture of the paint nozzle of the 1.3 nozzle module can, for example, measure 1.4 mm, with the possibility of reducing the medium flow rate, as compared to that of the 1.4 nozzle module, for example, by using different geometries and/or dimensions, especially angles and lengths, especially the length of a substantially hollow-cylindrical front section of the paint nozzle. At the same time or as an alternative, the spray medium outlet aperture of the paint nozzle of the 1.4 nozzle module can have an inside diameter greater than 1.4 mm.

The at least two, preferably at least four different nozzle modules of the nozzle module group of the set of nozzles according to the invention can optionally be mounted in or on one and the same base module of a spray gun. This means that a first nozzle module mounted on the base module, for example, a nozzle module with a first medium flow rate, for example, a 1.2 nozzle module with a medium flow rate of 150 g/min, can be removed, in particular unscrewed, from the base module, preferably by means of a quick screw cap, and a different nozzle module from the nozzle module group of set of nozzles according to the invention with a second medium flow rate, for example, a 1.5 nozzle module with a medium flow rate of 195 g/min, can be mounted on the same base module, preferably by means of the same quick screw cap.

Under the same spray conditions, the nozzle modules of the nozzle module group of the set of nozzles according to the invention have different medium flow rates, and the spray jets generated by means of the nozzle modules have substantially the same spray jet section height and spray jet section width. The spray conditions referred to being the same include, for example, the inlet flow pressure, the air pressure at the inlet of the spray gun, the distance and angle of the spray gun relative to the object to be coated, the medium to be sprayed, the extent of trigger actuation, the setting of a round or wide jet control, as well as ambient conditions, such as temperature, air humidity and ambient pressure. As mentioned above, in the case at hand, the spray image is intended to constitute the spray jet section. In this context, reference to the spray jet section height and the spray jet section width as being substantially the same means that the height and the width of the spray image, especially the core of the spray image, i.e., the zone of the spray image with the greatest coating thickness, are substantially the same. Most preferably, the spray jet sections of the different nozzle modules are congruent, i.e., with respect to shape and size, the spray images are substantially identical. Because of the different medium flow rates of the nozzle modules, the coating thickness of the spray images differs.

A nozzle module can especially comprise a spray medium nozzle and an air cap. In addition, it can comprise an air nozzle ring, by means of which the nozzle module can be screwed onto the base module, and a paint needle for closing and opening the spray medium outlet aperture of the spray medium nozzle.

The advantage of the set of nozzles according to the invention is that the user of the spray gun, for example, a vehicle painter, when changing the nozzle size, i.e., when replacing the nozzle module, which is mounted on the base module of the spray gun and which has a first medium flow rate, with a nozzle module having a second medium flow rate, does not have to change the spray jet section height and spray jet section width. Using the newly mounted nozzle, the user preferably achieves a spray jet having the same cross-sectional shape and dimension achieved with the removed nozzle. Therefore, after replacing the nozzle, the painter does not have to change the mode of operation previously used, especially the distance of the spray gun from the object to be coated.

The spray gun system according to the invention is characterized in that it comprises at least one set of nozzles described above and further described below and a base module, said nozzle modules of the set of nozzles being interchangeably mounted on the base module.

Each of the different nozzle modules from the different nozzle module groups can be interchangeably mounted on one and the same base module. The different nozzle modules preferably have the same connecting means so that they can be directly mounted on the base module, for example, by means of a thread, in particular a trapezoidal thread which can be configured in the form of a quick screw cap or connector, or by means of a bayonet lock, a plug-in connector, or by means of another connecting means known in the prior art. It is, however, also conceivable for a first nozzle module to have a type of connecting means different from that of a second nozzle module, and for one of the nozzle modules to be mounted on the base module by means of an adapter.

The method according to the invention for embodying a nozzle module, especially a nozzle module for a set of nozzles described above and further described below, comprises, as at least one step, the specification of at least one spray jet section height and/or one spray jet section width and/or one spray jet section to be generated by the nozzle module, and, as at least one additional step, the construction of the nozzle module which generates a spray jet with the defined spray jet section height and/or spray jet section width and/or spray jet section, with the method comprising the construction of an air cap, in particular the adjustment of an external horn air outflow angle and/or an internal horn air outflow angle and/or a control bore distance to a medium flow rate and/or to an internal nozzle pressure of the nozzle module, with the external horn air outflow angle being the angle at which horn air flows out of an external horn air outlet aperture of the air cap relative to a vertical axis, with the vertical axis extending perpendicularly relative to a central axis of the air cap, with the internal horn air outflow angle being the angle at which horn air flows out of an internal horn air outlet aperture of the air cap relative to the vertical axis, and with the control bore distance being the distance between at least one control bore in the air cap and a central aperture in the air cap.

For example, in the first step, it can be defined that the spray jet to be generated by the nozzle module should have a spray jet section height of approximately 27 cm and/or a spray jet section width of approximately 4 cm and/or an oval, in particular an elliptical cross-sectional shape. Again, this refers to the height, the width and the shape of the spray image, especially the core of the spray image. Next, the nozzle module is constructed, which generates a spray jet with the defined spray jet section height, spray jet section width and/or shape of the spray jet section. In particular, this involves the construction of an air cap for the nozzle module. Such an air cap can especially have two horns which are disposed diametrically opposite to one another and which project in the forward direction, i.e., in the spray direction, beyond a central aperture in the air cap. From the rear surface of the air cap, two supply bores, i.e., horn air inlet channels, extend to horn air outlet apertures in the horns. Preferably, each horn has at least two horn air outlet apertures, from which the horn air exits. As already described above, the horn air outlet apertures are typically oriented such that the horn air exiting from the horn air outlet apertures can influence the air, which has already exited from the above-mentioned annular gap, and the paint jet or the paint mist which has at least in part already been generated. Such an air cap can also have control apertures in the zone next to the central aperture. However, these control apertures, which hereinafter will be referred to as control bores although they do not necessarily have to be configured as bores, but which preferably are bores, extend into the inside of the air cap and, from there, are supplied with air when the spray gun is being operated. The air exiting from the control bores, the so-called control air, strikes and deflects the horn air exiting from the horn air outlet apertures and fans out the horn air jet, i.e., it widens and weakens the horn air jet. The control air also acts on the round jet and causes a slight preliminary deformation as well as further atomization. In both cases, the control air contributes to further atomizing the paint jet and reduces the contamination of the air cap by spray mist since it carries this mist away from the air cap. In particular, the air cap can have three control bores disposed on two oppositely lying sides of the central aperture, which control bores are arranged in the shape of a triangle, with a apex of the triangle being oriented in the direction of the internal or external horn air outlet apertures, i.e., the bore, which forms the apex of the triangle, is preferably located in line with the internal horn air outlet apertures, the external horn air outlet apertures and the center of the central aperture in the air cap. The control bores can have the same diameter, preferably measuring between 0.45 mm and 0.65 mm. However, the air cap can also have only two control bores disposed on two oppositely lying sides of the central aperture, which control bores are preferably located in line and in line with the internal horn air outlet apertures, the external horn air outlet apertures and the center of the central aperture in the air cap.

The method according to the invention comprises, in particular, adjusting an external horn air outflow angle and/or an internal horn air outflow angle and/or a control bore distance to a medium flow rate and/or to an internal nozzle pressure of the nozzle module, with the external horn air outflow angle being the angle at which horn air flows out of an external horn air outlet aperture of the air cap relative to a vertical axis, with the vertical axis extending perpendicularly relative to a central axis of the air cap, with the internal horn air outflow angle being the angle at which horn air flows out of an internal horn air outlet aperture of the air cap relative to the vertical axis, and with the control bore distance being the distance between at least one control bore in the air cap and a central aperture in the air cap.

It is obvious that the horn air, after exiting from horn air outlet aperture, spreads and fans out slightly. In the case at hand, the horn air outflow angle is defined as the angle at which the major portion of the horn air or the center of the horn air jet exits relative to the vertical axis described. In particular, the horn air outflow angle can be the angle of the central axis of the horn air outlet channel, especially of the horn air outlet bore, the end of which forms the horn air outlet aperture, relative to the vertical axis. The central axis of the air cap, relative to which the vertical axis extends perpendicularly, extends especially through the center of the central aperture in the air cap.

If a control bore is located in line with the horn air outlet apertures, the control bore distance is here defined as the distance between the above-mentioned central axis of the air cap and an axis parallel to this central axis through the center of the respective control bore. Alternatively, the control bore distance is here defined as the distance between the above-mentioned central axis and an axis extending parallel to this central axis through a projection of the center of the respective control bore onto the sectional plane. The sectional plane preferably extends especially along the central axis of the air cap and through the centers of the horn air outlet apertures.

In the context of the method according to the invention, adjusting an external horn air outflow angle and/or an internal horn air outflow angle and/or a control bore distance to a medium flow rate and/or to an internal nozzle pressure of the nozzle module means that the external horn air outflow angle, the internal horn air outflow angle and/or the control bore distance must be dimensioned as a function of a medium flow rate and/or an internal nozzle pressure. For example, if a nozzle module with a first medium flow rate and/or a first internal nozzle pressure generates a spray jet with the defined spray jet section height and/or spray jet section width and/or cross-sectional shape because it has a suitable external horn air outflow angle, a suitable internal horn air outflow angle and/or a suitable control bore distance, it will be necessary to change the external horn air outflow angle, the internal horn air outflow angle and/or the control bore distance for a second median flow rate different from the first medium flow rate and/or a second internal nozzle pressure different from the first internal nozzle pressure in order to obtain a spray jet with the defined spray jet section height and/or spray jet section width and/or cross-sectional shape. The medium flow rate will be different especially if a nozzle with a different nozzle size is used. The internal nozzle pressure will be different especially if first a low-pressure nozzle module and subsequently a high-pressure nozzle module is used, or if first a low-pressure base module and subsequently a high-pressure base module is used. However, changes to the air cap can also have an influence on the internal nozzle pressure.

In the context of the present method, an external horn air outflow angle, an internal horn air outflow angle and/or a control bore distance of the air cap are precisely adjusted to the medium flow rate and/or the internal nozzle pressure of the nozzle module so as to ensure that the nozzle module generates a spray jet with the defined, i.e., desired, spray jet section height and/or spray jet section width and/or cross-sectional shape. The external horn air outflow angle of the first horn is preferably identical to the external horn air outflow angle of the second horn, the internal horn air outflow angle of the first horn is identical to the internal horn air outflow angle of the second horn, and the control bore distance or the control bore distances of the control bores on one side of the central aperture is/are identical to the control bore distance or the control bore distances of the control bores on the opposite side of the central aperture.

The method according to the invention for selecting a nozzle module from a set of nozzles described above and further described below for use for a paint job is characterized in that the method comprises at least the selection and/or specification of one or a plurality of the following attributes of the paint job: the previously used nozzle module of a set of nozzles as in one of claims 1 to 8, the previously used nozzle module of a different set of nozzles, the type of pressure spray painting technique, the spray gun model, the spray gun manufacturer, the type of medium to be sprayed, the viscosity of the medium to be sprayed, the recommendation of the manufacturer of the medium to be sprayed, the shape of the spray jet, the coating thickness, the ambient condition, the painting speed, the controllability and the nozzle size, and in that, based on the selection and/or specification, a proposal for a nozzle module of the set of nozzles is generated. The method can include a number of different steps in which different selection and specification options are considered. For example, in a first step, the selection and/or specification can focus on whether the proposal for a nozzle module of the set of nozzles should be generated based on a previously used nozzle module of a set of nozzles described above and further described below, a previously used nozzle module of a different set of nozzles, the type of medium to be sprayed and/or based on the coating thickness to be achieved, especially on the coating thickness to be achieved per spraying pass. Depending on the selection and/or specification, a number of different additional attributes of the paint job can be selected and/or specified. As an option of the type of medium to be sprayed, for example, a water-based paint, a solvent-based paint, a varnish or a 2-component paint can be selected or specified. As an option of the type of pressure spray painting technique, e.g., low-pressure techniques, in particular HVLP, or high-pressure techniques, in particular compliant technology can be selected or specified. As an option for the used nozzle size, a single nozzle size, for example, 1.1, 1.2 or 1.3, a range of nozzle sizes, for example, 1.0 to 1.2, 1.3 to 1.5, etc., can be selected or specified. The viscosity of the medium to be sprayed can be selected or defined as a numerical value or as a viscosity range, e.g., low viscosity, normal viscosity or high viscosity, preferably specifying a value range, especially the time in seconds it takes for the medium to completely drain from a standard size container, especially a DIN4 cup. As an option for the desired shape of the spray jet section, e.g., a spray jet with a cross section having, an at least in certain areas, a substantially constant width (I-jet) or a spray jet with a cross section having a substantially oval, in particular substantially elliptical shape (O-jet) can be specified or selected. The ambient conditions to be selected or specified can include, in particular, the temperature and/or the relative air humidity in the paint spray booth in which the nozzle module is to be used. The specification of the painting speed and the controllability can preferably be designed as mutually influencing slide controls which indicate whether the user attaches greater importance to high painting speed or to good controllability of the application. The sum of the value for the importance of the painting speed and the value for the importance of the controllability can, in particular, always equal 100%. If the user of the method according to the invention moves the slide control for painting speed up, the slide control for controllability automatically moves down. Thus, the settings can be, e.g., 0% painting speed and 100% controllability if the user attaches importance only to good controllability; it can be 100% painting speed and 0% controllability if the user attaches importance only to painting speed; or it can be 25% painting speed and 75% controllability, 50% painting speed and 50% controllability, 75% painting speed and 25% controllability. The specification can, in particular, be made in 1% increments. The proposal for a nozzle module of the set of nozzles, which is generated based on the selection and/or specification of one or a plurality of attributes of the paint job, is preferably output, especially displayed. Preferably, the method according to the invention provides for sending the proposal for a nozzle module of the set of nozzles by email or by means of another data transmission system.

The selection system according to the invention, especially a "slide-gate system," for implementing the aforementioned method, is characterized in that it comprises selection and/or input means for selecting and inputting the attributes of the paint job as well as means for generating and presenting a proposal for a nozzle module of the set of nozzles. The selection system can consist, for example, of a plurality of elements which can be moved relative to each other, for example, elements made of paper or cardboard, which constitute the selection and/or input means for selecting and/or inputting the attributes of the paint job. Once the selection and input of the attributes of the paint job have been completed, the selection system according to the invention then presents the proposal for a nozzle module of the set of nozzles.

The computer program product according to the present invention is characterized in that it includes commands which, during the execution of the program by a data processing device, cause this program to generate a method and/or the steps of the selection system described above and further described below. In particular, the computer program product according to the invention can have a menu navigation which, complementary to the selection system described above and further described below and the method described above and further described below for selecting a nozzle module from a set of nozzles for a paint job, includes different steps with different selection and/or specification options. For example, in a first step, the selection and/or specification here again can focus on whether the proposal for a nozzle module of the set of nozzles should be generated based on a previously used nozzle module of a set of nozzles described above and further described below, a previously used nozzle module of a different set of nozzles, the type of medium to be sprayed, and/or based on the coating thickness to be achieved, especially on the coating thickness to be achieved per spraying pass. Depending on the selection and/or specification, a number of different additional menu items can appear, by means of which the attributes of the paint job can be selected and/or defined. Issues discussed above in the context of the description of the method according to the invention apply mutatis mutandis to the computer program product according to the invention. The data processing device mentioned can especially be a smartphone or a desktop, notebook or tablet computer. The computer program product according to the invention can be designed such that the proposal for a nozzle module of the set of nozzles, which is generated based on the selection and/or specification of one or a plurality of attributes of the paint job, is output and, in particular, displayed. Most preferably, the computer program product according to the invention is designed such that the proposal for a nozzle module of the set of nozzles can be sent per email or by means of another data transmission system.

Advantageous embodiments are also disclosed.

The set of nozzles according to the invention preferably includes at least one additional (second) nozzle module group which comprises at least two, preferably at least four, different nozzle modules for optional mounting in or on one and the same base module, with the nozzle modules of the additional nozzle module group also being designed such that they have different medium flow rates under the same spray conditions and that the spray jets generated by means of the nozzle modules have substantially the same spray jet section height and the same spray jet section width, and that, in particular, the spray jet of the different nozzle modules are congruent, with the spray jets generated by means of the nozzle modules of the two nozzle module groups each having different cross-sectional shapes, in particular such that the spray jets generated by means of the nozzle modules of one nozzle module group have a cross section having, in an at least certain areas, a substantially constant width (I-nozzle modules) and the spray jets generated by means of the nozzle modules of the different nozzle module group have a cross section with a substantially oval, in particular substantially elliptical shape (O-nozzle modules).

The above explanations in respect of the set of nozzles according to the invention here apply mutatis mutandis.

Like the above-described nozzle module group of the set of nozzles according to the invention, which will hereinafter be referred to as the first nozzle module group, the additional, or more specifically second, nozzle module group also comprises at least two, preferably at least four, different nozzle modules for optional mounting in or on one and the same base module, with the nozzle modules of the additional nozzle module group also being designed such that they have different medium flow rates under the same spray conditions and that the spray jets generated by means of the nozzle modules have substantially the same spray jet section height and the same spray jet section width, and that, in particular, the spray jets sections of the different nozzle modules are congruent.

Further, the spray jets generated by means of the nozzle modules of the two nozzle module groups, i.e., the first nozzle module group and the additional, or more specifically second, nozzle module group, each have different cross-sectional shapes, in particular such that the spray jets generated by means of the nozzle modules of one nozzle module group have a cross section having, in an at least certain areas, a substantially constant width (I-nozzle modules) and the spray jets generated by the other nozzle module group have a cross section with a substantially oval, in particular substantially elliptical shape (O-nozzle modules). The nozzle modules generating spray jets with a cross section having, at least in certain areas, a substantially constant width will hereinafter be referred to as I-nozzle modules, and a spray jet generated by means of an I-nozzle module will be referred to as I-jet. The nozzle modules with spray jets having a substantially oval, in particular substantially elliptical shape will hereinafter be referred to as O-nozzle modules, and a spray jet generated by means of an O-nozzle module will be referred to as O-jet. An I-jet is distinguished by an elongated jet shape with short tapered zones at the top and bottom in the spray image, which is the reason why an I-jet is especially well suited for a controlled application, in particular because, at a defined painting speed, a smaller amount of paint per surface area is applied. An O-jet with its substantially oval, in particular substantially elliptical jet shape has a longer tapered zone at the top and bottom in the spray image and is well suited mainly for quick applications, in particular because a greater amount of paint per surface area is applied than with the same painting speed.

This special configuration allows users of the set of nozzles according to the invention to choose the jet shape suitable for their mode of operation. If the user attaches greater importance to good controllability of the application, the user will choose one of the I-nozzle modules; if the user attaches greater importance to high painting speed, the user will choose one of the O-nozzle modules.

Both the first nozzle module group and the additional, or more specifically second, nozzle module group each have different nozzle modules which have different medium flow rates under the same spray conditions. At the same time, under the same spray conditions, the nozzle modules within one nozzle module group generate spray jets with substantially the same spray jet section height and the same spray jet section width, and in particular, the cross-sectional shape of the spray jet generated by means of the different nozzle modules within one group are congruent. Across multiple groups, the spray jet section height, the spray jet section width and/or shape of the cross sections of the spray jets can differ.

The set of nozzles preferably has at least one additional (third) nozzle module group which comprises at least two, preferably at least four, different nozzle modules for optional mounting in or on one and the same base module, with the nozzle modules of the additional nozzle module group also being designed such that they have different medium flow rates under the same spray conditions and that the spray jets generated by means of the nozzle modules have substantially the same spray jet section height and the same spray jet section width, and that, in particular, the spray jet sections of the different nozzle modules are congruent, with the nozzle modules of one nozzle module group being configured as low-pressure nozzle modules and the nozzle modules of the additional nozzle module group being configured as high-pressure nozzle modules.

Spray guns, especially paint spray guns, operate according to different pressure spray painting techniques. Conventional spray guns operate at relatively high spray pressures of several bar. In so-called HVLP guns, the internal nozzle pressure is at most 10 psi or 0.7 bar, which achieves transmission rates considerably higher than 65%. Compliant spray guns, on the other hand, have an internal nozzle pressure higher than 10 psi or 0.7 bar; however, they also achieve a transmission rate higher than 65%.

The internal nozzle pressure of the spray gun is defined as the pressure which exists in the air cap of the spray gun. Frequently, the atomizing air zone is separated from the horn air zone, and in the atomizing air zone, the pressure can be different from the pressure existing in the horn air zone. However, the pressures in the atomizing air zone and in the horn air zone can also be the same. The internal nozzle pressure can be measured, for example, by means of a so-called test air cap. This test air cap is a special air cap which is mounted on the spray gun instead of the conventional air cap. As a rule, the test air cap has two manometers, one of which is connected to the atomizing air zone via a bore in the test air cap, and the other manometer is connected to the horn air zone via an additional bore in the test air cap.

In this context, the terms low-pressure nozzle module and high-pressure nozzle module are not intended to suggest that the respective nozzle module is used only in conventional low-pressure or high-pressure spray guns or that by using the respective nozzle module, the spray gun is turned into a conventional low-pressure spray gun, in particular a HVLP spray gun, or into a conventional high-pressure gun. Instead, it only means that the spray gun, when fitted with a high-pressure nozzle module, has a higher internal nozzle pressure than when fitted with a low-pressure nozzle module. Preferably, a spray gun fitted with a low-pressure nozzle module or a base module fitted with a low-pressure nozzle module meets the criteria of an HVLP spray gun, and the spray gun fitted with a high-pressure nozzle module or a base module fitted with a high-pressure nozzle module meets the criteria of a compliant spray gun.

The fact that the nozzle modules of one nozzle module group are configured as low-pressure nozzle modules and the nozzle modules of the additional nozzle module group as high-pressure nozzle modules allows users to choose the nozzle module best suited to their mode of operation. If they attach more importance to high transmission rates and thus to a reduction of the amount of spray medium used, they will choose one of the low-pressure nozzle modules, in particular HVLP nozzle modules. If they attach more importance to a higher painting speed and/or if the compressor available to them is too small for the HVLP method, which requires a higher air volume than the compliant guns, they will choose one of the high-pressure nozzle modules, in particular compliant nozzle modules.

Most preferably, the spray jets generated by means of the low-pressure nozzle modules and the spray jets generated by means of the high-pressure nozzle modules have the same cross-sectional shape such that the spray jets generated by means of the low-pressure nozzle modules and the spray jets generated by means of the high-pressure nozzle modules have a cross section with, at least in certain areas, a substantially constant width (I-nozzle modules) or a cross section with a substantially oval, in particular substantially elliptical shape (O-nozzle modules). In this context, the term "same cross-sectional shape" refers to a same basic shape, or more specifically, the cross-sectional shape having, in at least in certain areas, a substantially constant width is a shape which is independent of different spray jet section heights, spray jet section widths or ratios of spray jet section height to spray jet section width. Similarly, the cross-sectional shape with a substantially oval, in particular substantially elliptical shape is a shape which is independent of different spray jet section heights, spray jet section widths or ratios of spray jet section height to spray jet section width.

As a result, a user who prefers an above-described I-jet has the option to choose between a low-pressure nozzle module and a high-pressure nozzle module, without having to give up a particularly preferred jet shape. The same applies mutatis mutandis to users who prefer an above-described O-jet.

Most preferably, the set of nozzles comprises at least two, preferably at least four, different nozzle module groups, with the nozzle modules of the nozzle module groups preferably being configured such that it is possible to dedicate, to each nozzle module of one nozzle module group, a nozzle module of at least one different nozzle module group or different nozzle module groups, which nozzle module has the same medium flow rate under the same spray conditions.

One of the nozzle module groups mentioned can comprise at least two, preferably at least four, different nozzle modules for optional mounting in or on one and the same base module, with all of the nozzle modules of this nozzle module group being configured as low-pressure nozzle modules, especially HVLP nozzle modules, and as I-nozzle modules, and with all of the spray jets, especially the spray jet sections, having the same spray jet section height, the same spray jet section width and the same cross-sectional shape, in particular with their spray jet sections being congruent. The individual nozzle modules within the nozzle module group each have different medium flow rates, especially different nozzle sizes, in particular different nominal nozzle sizes.

Another one of the nozzle module groups mentioned can comprise at least two, preferably at least four, different nozzle modules for optional mounting in or on one and the same base module, with all of the nozzle modules of this nozzle module group also being configured as low-pressure nozzle modules, especially HVLP nozzle modules, however not as I-nozzle modules but as O-nozzle modules, and with all of the spray jets of these nozzle modules, especially the spray jet sections, also having the same spray jet section height, the same spray jet section width and the same cross-sectional shape, in particular with their spray jet sections being congruent. The individual nozzle modules within the nozzle module group each have different medium flow rates, especially different nozzle sizes, in particular different nominal nozzle sizes.

Another one of the nozzle module groups mentioned can comprise at least two, preferably at least four, different nozzle modules for optional mounting in or on one and the same base module, with the nozzle modules of this nozzle module group not being configured as low-pressure nozzle modules, especially HVLP nozzle modules, but as high-pressure nozzle modules, especially compliant nozzle modules and also as O-nozzle modules, and with all of the spray jets of these nozzle modules, especially the spray jet sections, having the same spray jet section height, the same spray jet section width and the same cross-sectional shape, in particular with their spray jet sections being congruent. The individual nozzle modules within the nozzle module group each have different medium flow rates, especially different nozzle sizes, in particular different nominal nozzle sizes.

Yet another one of the nozzle module groups mentioned can comprise at least two, preferably at least four, different nozzle modules for optional mounting in or on one and the same base module, with the nozzle modules of this nozzle module group also being configured as high-pressure nozzle modules, especially compliant nozzle modules, however not has O-nozzle modules but as I-nozzle modules, and with all of the spray jets of these nozzle modules, especially the spray jet sections, having the same spray jet section height, the same spray jet section width and the same cross-sectional shape, in particular with their spray jet sections being congruent. The individual nozzle modules within the nozzle module group each have different medium flow rates, especially different nozzle sizes, in particular different nominal nozzle sizes.

The individual nozzle module groups can also stand alone and form a set of nozzles, or they can be combined with any other nozzle module group and as such form a set of nozzles. For example, the above nozzle module group referred to as the second nozzle module group can stand alone without the above-mentioned first nozzle module group and by itself form a set of nozzles, or the second nozzle module group and the third and/or fourth nozzle module group can form a set of nozzles without the first nozzle module group. The third and the fourth nozzle module group together can also form a set of nozzles without the first and second nozzle module group.

Configuring the nozzle modules of the nozzle module groups preferably such that, to each nozzle module of a nozzle module group, a nozzle module of at least one different nozzle module group or nozzle module groups can be dedicated, which nozzle module has the same medium flow rate under the same spray conditions, means that, for example, in at least two of the nozzle module groups, one nozzle module has a medium flow rate of 150 g/min.

Most preferably, the nozzle modules of the nozzle module groups are configured in such a way that, to each nozzle module of a nozzle module group, a nozzle module of at least one different nozzle module group or groups can be dedicated, which nozzle module has the same nozzle size, especially the same nominal nozzle size. For example, at least two, preferably four, of the nozzle module groups can have a 1.1 nozzle module, a 1.2 nozzle module, a 1.3 nozzle module and a 1.4 nozzle module.

The nozzle modules of a set of nozzles according to the invention preferably comprise at least one air cap, each with at least one internal horn air outlet aperture and one external horn air outlet aperture, wherein, from the at least one external horn air outlet aperture, horn air exits at a defined external horn air outflow angle relative to a vertical axis, with the vertical axis extending perpendicularly relative to a central axis of the first air cap, wherein, from the at least one internal horn air outlet aperture, horn air exits at a defined internal horn air outflow angle relative to the vertical axis, and wherein, in the different nozzle modules of at least one nozzle module group, the sums of the external horn air outflow angle and the internal horn air outflow angle within one nozzle module differ.

The above explanations in respect of the method according to the invention for embodying a nozzle module here apply mutatis mutandis. If in a first nozzle module of a nozzle module group, for example, the external horn air outflow angle relative to the vertical axis measures 16° and the internal horn air outflow angle relative to the vertical axis measures 21.5°, the sum of the external horn air outflow angle and the internal horn air outflow angle measures 37.5°. If in a second nozzle module of the same nozzle module group, for example, the external horn air outflow angle relative to the vertical axis measures 17° and the internal horn air outflow angle relative to the vertical axis measures 22°, the sum of the external horn air outflow angle and the internal horn air outflow angle measures 39°. For the sum of the external horn air outflow angle and the internal horn air outflow angle to be changed, it is obviously not necessary to change both the external horn air outflow angle and the internal horn air outflow angle; instead, it suffices to change only one of the angles. Most preferably, the sum of the external horn air outflow angle and the internal horn air outflow angle increases as the medium flow rate increases. More specifically, in the HVLP-nozzle modules with an I-jet, the sum mentioned can be between 37° and 44°, in the HVLP-nozzle modules with an O-jet, it can be between 36° and 41.5°, in the compliant nozzle modules with an I-jet, it can be between 44° and 46.5°, and in the compliant nozzle modules with an O-jet, it can be between 44.5° and 48.5°.

The nozzle modules of a set of nozzles according to the invention preferably each have at least one air cap, each with at least one central aperture and at least two control bores, with the control bores on opposite sides of the at least one central aperture being disposed, in particular, diametrically to each other and at a defined control bore distance relative to the at least one central aperture, characterized in that the control bore distance in the different nozzle modules of at least one nozzle module group is different.

The above explanations in respect of the method according to the invention for embodying a nozzle module here apply mutatis mutandis, especially the explanations in respect of the number and configuration of the control bores and the measurement of the control bore distance between the control bores and the central aperture.

The nozzle modules of a set of nozzles according to the invention preferably each have at least one spray medium nozzle with a substantially hollow-cylindrical front section and a spray medium outlet aperture, with the inside diameter of said outlet aperture and/or the axial extension of the substantially hollow-cylindrical front section of the spray medium nozzle being different in the different nozzle modules of at least one nozzle module group. Thus, a different medium flow rate is achieved.

The nozzle modules of a nozzle module group of a set of nozzles according to the invention are preferably configured in a such a way that the medium flow rate between nozzle modules consecutively following each other at increasing medium flow rates increases by an equidistant value, preferably by a value between 10 and 20 g/min, especially by a value of 15 g/min. This means that a nozzle module group comprises, for example, a 1.2 nozzle module and a 1.3 nozzle module, with the 1.2 nozzle module and the 1.3 nozzle module following one another at an increasing medium flow rate, which means that within the nozzle module group, the 1.3 nozzle module has the next higher medium flow rate relative to the 1.2 nozzle module, which means that within the nozzle module group, no nozzle module has a medium flow rate which is between the medium flow rate of the 1.2 nozzle module and the medium flow rate of the 1.3 nozzle module, and with the 1.3 nozzle, under the same spray conditions, having a medium flow rate which is higher by 10 to 20 g/min, preferably by 15 g/min. Most preferably, a nozzle module group comprises at least four nozzle modules which are configured such that under the same spray conditions, the medium flow rate between nozzle modules, which consecutively follow each other at an increasing medium flow rate, increases by an equidistant value, preferably by a value between 10 and 20 g/min, especially by a value of 15 g/min. A nozzle module group, for example, comprises a 1.1, a 1.2, a 1.3 and a 1.4 nozzle module, which nozzle modules follow each other at an increasing medium flow rate, with the medium flow rate, for example, of the 1.1 nozzle being 135 g/min, the medium flow rate of the 1.2 nozzle being 150 g/min, the medium flow rate of the 1.3 nozzle being 165 g/min and the medium flow rate of the 1.4 nozzle being 180 g/min. Such a medium flow rate which evenly increases with increasing nozzle size offers the user considerably advantages.

The method according to the invention for embodying a nozzle module preferably includes the production of the nozzle module. Most preferably, the method also includes the shipment of the nozzle module to the customer and the use of the nozzle module.

BRIEF DESCRIPTION OF THE DRAWINGS

Embodiments of the invention will be explained in more detail below by way of example, with reference to the 5 figures. The figures show.

DETAILED DESCRIPTION

Figure 1:
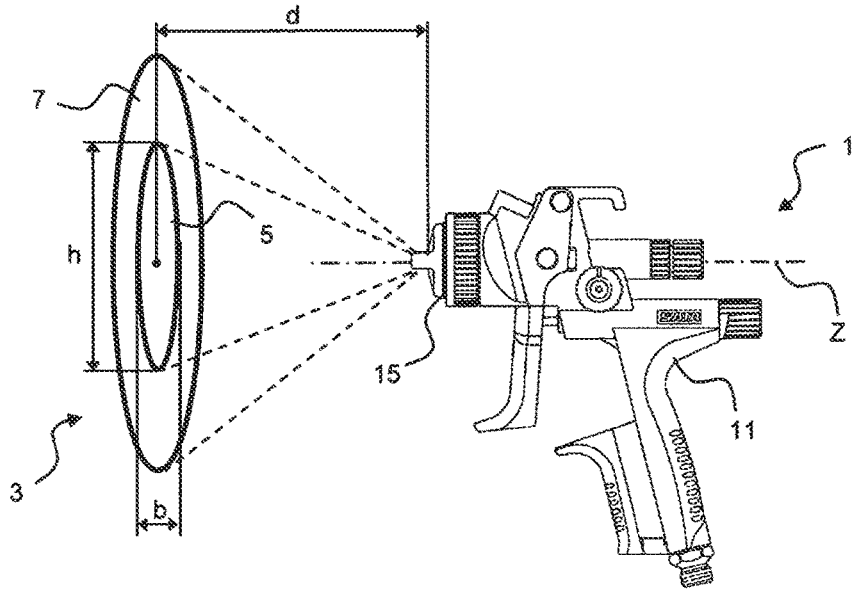
FIG. 1 a schematic representation of a spraying procedure.

FIG. 1 shows a schematic representation of how a spray jet or, more specifically, a spray image 3 is generated by means of a spray gun 1 which here takes the form of a compressed-air atomizing paint spray gun. The spray gun 1 comprises, in particular, a base module 11 and a nozzle module 15 which is mounted on the base module 11. In the example at hand, the nozzle module 15 or, more specifically, the spray gun 1 with the nozzle module 15, generates an above-described O-jet; however, the situation for an I-jet is substantially the same. The figure does not show a realistic view; instead, the spray gun 1 is shown in a in a lateral view, and the spray image 3 is shown in a front view relative to the spray image 3. The broken lines illustrate the upper and lower outermost boundaries of the spray jet generated and the upper and lower outermost boundaries of the core of the spray jet. When striking a flat object which is disposed perpendicularly relative to the longitudinal axis Z and at a spraying distance d relative to the nozzle, especially relative to the front end of a spray medium nozzle, of the spray gun, the spray jet generates the spray image 3 with its outer spray jet zone 7 and its core or core zone 5. The outermost boundaries of the outer spray jet zone 7 and the transition between the outer spray jet zone 7 and the core zone 5 are fluid. In realistic spray images, however, at least the core zone 5 can, as a rule, be readily identified and measured. The core zone 5 has a defined height and a defined width, here referred to as spray jet section height h and spray jet section width b. Here, the longitudinal axis Z is a longitudinal axis of the upper part of the spray gun 1, a spraying axis, a longitudinal axis of the nozzle and a central axis of the air cap.

Figure 2:
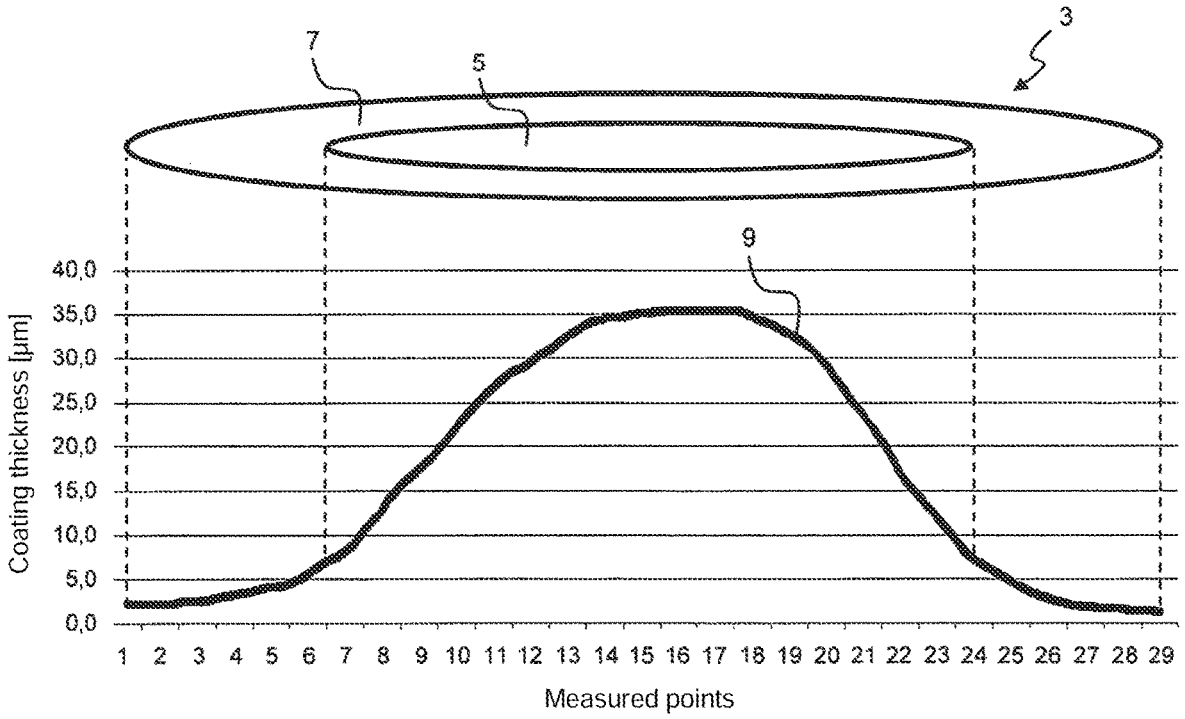
FIG. 2 a schematic diagram of an example of a coating thickness profile across the height of the spray image.

The spray jet 3 illustrated in FIG. 2 is shown rotated by 90° with respect to the representation in FIG. 1. FIG. 2 schematically shows an example of a coating thickness profile across the height of the entire spray jet. The curve 9 in the diagram shows an initially relatively flat slope of the coating thickness in μm in the outer spray jet zone 7. In the core zone 5, the coating thickness increases sharply, then reaches its peak and subsequently again drops sharply. In the outer spray jet zone 7, the curve 9 flattens again. The distance between the measured points, which form the X-axis of the diagram, here is not equal to 1 cm.

Figure 3:
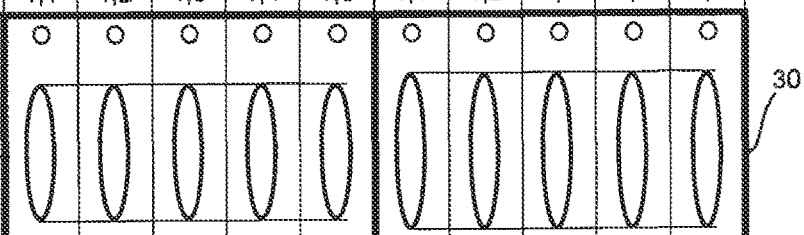
FIG. 3 a table listing examples of nozzle modules of different nozzle module groups of an embodiment of a set of nozzles according to the invention.
Figure 3:
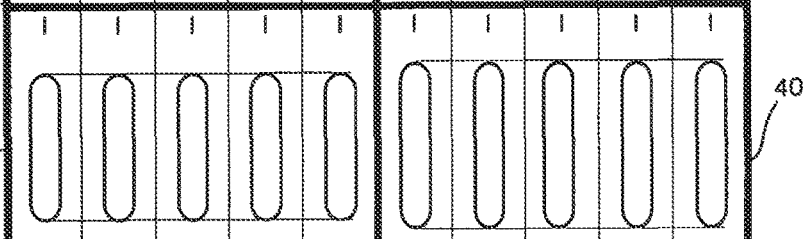

FIG. 3 shows a table with examples of different nozzle modules of different nozzle module groups 10, 20, 30, 40 of an embodiment of a set of nozzles according to the invention. In the table, the individual nozzle module groups 10, 20, 30, 40 are outlined in bold. The first nozzle module group 10 comprises five nozzle modules of different nozzle sizes, especially different nominal nozzle sizes. The medium flow rate of the five nozzle modules within the nozzle module group 10 increases from one nozzle size to the next by an equidistant value, i.e., 15 g/min. The 1.1 nozzle module has a medium flow rate of 135 g/min, the 1.2 nozzle module has a medium flow rate of 150 g/min, the 1.3 nozzle module has a medium flow rate of 165 g/min, the 1.4 nozzle module has a medium flow rate of 180 g/min, and the 1.5 nozzle module has a medium flow rate of 195 g/min. All nozzle modules within the nozzle module group 10 are configured as HVLP nozzle modules, i.e., as low-pressure nozzle modules, and all nozzle modules have the same spray jet section height and the same spray jet section width, which, as already mentioned above, are here defined as the spray jet section height h and the spray jet section width b of a core zone 5 illustrated in FIG. 1 and FIG. 2. The spray jet sections, i.e., the core zones 5 of the spray images generated by the nozzle modules within the nozzle module group 10, are congruent, i.e., they have the same shape and the same size. Only the coating thickness of the core zone 5 of the spray image would be different due to the different medium flow rate. The spray jet section height and the spray jet section width of the nozzle modules of the nozzle module group 10 serve as a reference for the spray jet section heights and spray jet section widths of the nozzle modules of the other nozzle module groups and are therefore shown at 100%. The nozzle modules of the nozzle module group 10 are configured in the form of the above-described O-nozzle modules, i.e., they each generate a spray jet, the cross section of which has a substantially oval, in particular substantially elliptical shape.

Thus, the user of an embodiment of a set of nozzles according to the invention, which comprises at least two nozzle modules of the nozzle module group 10, can change the nozzle size of the spray gun used, i.e., the user can remove the first nozzle module having a first nozzle size, in particular nominal nozzle size, mounted on the base module of the spray gun and mount a different nozzle module of the nozzle module group 10 having a different nozzle size, in particular nominal nozzle size, on the same base module, and achieve a spray jet with the same spray jet section height, spray jet section width and cross-sectional shape at a defined changed medium flow rate.

Another nozzle module group 20 also comprises five nozzle modules with different nozzle sizes, in particular different nominal nozzle sizes. The medium flow rate of the five nozzle modules within the nozzle module group 20 increases from one nozzle size to the next by an equidistant value, i.e., 15 g/min. The 1.1 nozzle module has a medium flow rate of 135 g/min, the 1.2 nozzle module has a medium flow rate of 150 g/min, the 1.3 nozzle module has a medium flow rate of 165 g/min, the 1.4 nozzle module has a medium flow rate of 180 g/min, and the 1.5 nozzle module has a medium flow rate of 195 g/min. All nozzle modules within the nozzle module group 20 are configured in the form of HVLP nozzle modules, i.e., as low-pressure nozzle modules, and all nozzle modules have the same spray jet section height and the same spray jet section width, which, as already mentioned above, are here defined as the spray jet section height h and the spray jet section width b of a core zone 5 illustrated in FIG. 1 and FIG. 2. The spray jet sections, i.e., the core zones 5 of the spray images generated by the nozzle modules within the nozzle module group 20, are congruent, i.e., they have the same shape and the same size. Only the coating thickness of the core zone 5 of the spray image would be different due to the different medium flow rate. The spray jet section height of the nozzle modules of the nozzle module group 20 is greater than the spray jet section height of the nozzle modules of the nozzle module group 10, in the example at hand, greater by 6%. The spray jet section width of the nozzle modules of the nozzle module group 20, on the other hand, is smaller than the spray jet section width of the nozzle modules of the nozzle module group 10, in the case at hand, it amounts to 88% of the spray jet section width of the nozzle modules of the nozzle module group 10. The nozzle modules of the nozzle module group 20 are configured in the form of the above-described I-nozzle modules, i.e., they each generate a spray jet, the cross section of which has, at least in certain areas, a substantially constant width.

Thus, the user of an embodiment of a set of nozzles according to the invention, which comprises at least two nozzle modules of the nozzle module group 20, can change the nozzle size of the spray gun used, i.e., the user can remove the first nozzle module having a first nozzle size, in particular nominal nozzle size, disposed on the base module of the spray gun and mount a different nozzle module of the nozzle module group 20 having a different nozzle size, in particular nominal nozzle size, on the same base module, and achieve a spray jet with the same spray jet section height, spray jet section width and cross-sectional shape at a defined changed medium flow rate.

Another nozzle module group 30 also comprises five nozzle modules with different nozzle sizes, in particular different nominal nozzle sizes. The medium flow rate of the five nozzle modules within the nozzle module group 30 increases from one nozzle size to the next by an equidistant value, i.e., 15 g/min. The 1.1 nozzle module has a medium flow rate of 155 g/min, the 1.2 nozzle module has a medium flow rate of 170 g/min, the 1.3 nozzle module has a medium flow rate of 185 g/min, the 1.4 nozzle module has a medium flow rate of 200 g/min, and the 1.5 nozzle module has a medium flow rate of 215 g/min. All nozzle modules within the nozzle module group 30 are configured as compliant nozzle modules, i.e., in the above understanding as high-pressure nozzle modules, and all nozzle modules have the same spray jet section height and the same spray jet section width, which, as already mentioned above, are here again defined as the spray jet section height h and the spray jet section width b of a core zone 5 illustrated in FIG. 1 and FIG. 2. The spray jet sections, i.e., the core zones 5 of the spray images generated by the nozzle modules within the nozzle module group 30, are congruent, i.e., they have the same shape and the same size. Only the coating thickness of the core zone 5 of the spray image would be different due to the different medium flow rate. The spray jet section height of the nozzle modules of the nozzle module group 30 is greater than the spray jet section height of the nozzle modules of the nozzle module group 10, in the example at hand, greater by 15%. The spray jet section width of the nozzle modules of the nozzle module group 30 is the same as the spray jet section width of the nozzle modules of the nozzle module group 10. The nozzle modules of the nozzle module group 30 are configured in the form of the above-described O-nozzle modules, i.e., they each generate a spray jet, the cross section of which has an oval, in particular substantially elliptical shape.

Thus, the user of an embodiment of a set of nozzles according to the invention, which comprises at least two nozzle modules of the nozzle module group 30, can change the nozzle size of the spray guns used, i.e., the user can remove the first nozzle module having a first nozzle size, in particular nominal nozzle size, mounted on the base module of the spray gun and mount a different nozzle module of the nozzle module group 30 having a different nozzle size, in particular nominal nozzle size, on the same base module, and achieve a spray jet with the same spray jet section height, spray jet section width and cross-sectional shape at a defined changed medium flow rate.

Another nozzle module group 40 also comprises five nozzle modules with different nozzle sizes, in particular different nominal nozzle sizes. The medium flow rate of the five nozzle modules within the nozzle module group 40 increases from one nozzle size to the next by an equidistant value, i.e., by 15 g/min. The 1.1 nozzle module has a medium flow rate of 155 g/min, the 1.2 nozzle module has a medium flow rate of 170 g/min, the 1.3 nozzle module has a medium flow rate of 185 g/min, the 1.4 nozzle module has a medium flow rate of 200 g/min, and the 1.5 nozzle module has a medium flow rate of 215 g/min. All nozzle modules within the nozzle module group 40 are configured as compliant nozzle modules, i.e., in the above understanding as high-pressure nozzle modules, and all nozzle modules have the same spray jet section height and the same spray jet section width, which, as already mentioned above, are here again defined as the spray jet section height h and the spray jet section width b of a core zone 5 illustrated in FIG. 1 and FIG. 2. The spray jet sections, i.e., the core zones 5 of the spray images generated by the nozzle modules within the nozzle module group 40, are congruent, i.e., they have the same shape and the same size. Only the coating thickness of the core zone 5 of the spray image would be different due to the different medium flow rate. The spray jet section height of the nozzle modules of the nozzle module group 40 is greater than the spray jet section height of the nozzle modules of the nozzle module group 10, in the example at hand, greater by 20%. The spray jet section width of the nozzle modules of the nozzle module group 40, on the other hand, is smaller than the spray jet section width of the nozzle modules of the nozzle module group 10, in the case at hand, it amounts to 88% of the spray jet section width of the nozzle modules of the nozzle module group 10. The nozzle modules of the nozzle module group 40 are configured in the form of the above-described I-nozzle modules, i.e., they each generate a spray jet, the cross section of which has, at least in certain areas, a substantially constant width.

Thus, the user of an embodiment of a set of nozzles according to the invention, which comprises at least two nozzle modules of the nozzle module group 40, can change the nozzle size of the spray guns used, i.e., the user can remove the first nozzle module having a first nozzle size, in particular nominal nozzle size, mounted on the base module of the spray gun and mount a different nozzle module of the nozzle module group 40 having a different nozzle size, in particular nominal nozzle size, on the same base module, and achieve a spray jet with the same spray jet section height, spray jet section width and cross-sectional shape at a defined changed medium flow rate.

A set of nozzles according to the invention for a spray gun, in particular a compressed-air atomizing paint spray gun, can comprise at least two, preferably at least four, different nozzle modules from the same nozzle module group for optional mounting in or on one and the same base module of a spray gun, which offers the user the advantages mentioned.

In addition, however, a set of nozzles according to the invention can each also have at least two, preferably at least four, different nozzle modules from one or a plurality of different nozzle module groups for optional mounting in or on one and the same base module. For example, a set of nozzles according to the invention can comprise at least two, preferably at least four, different nozzle modules from the nozzle module group 10 and at least two, preferably at least four, different nozzle modules from the nozzle module group 20 and/or at least two, preferably at least four, different nozzle modules from the nozzle module group 30 and/or at least two, preferably at least four, different nozzle modules from the nozzle module group 40.

Alternatively, a set of nozzles according to the invention can comprise, for example, at least two, preferably at least four, different nozzle modules from the nozzle module group 20 and at least two, preferably at least four, different nozzle modules from the nozzle module group 30 and/or at least two, preferably at least four, different nozzle modules from the nozzle module group 40.

Alternatively, a set of nozzles according to the invention can comprise, for example, at least two, preferably at least four, different nozzle modules from the nozzle module group 30 and at least two, preferably at least four, different nozzle modules from the nozzle module group 40.

A set of nozzles according to the invention can preferably comprise at least two, preferably at least four, different nozzle modules from three different nozzle module groups; most preferably, however, a set of nozzles according to the invention comprises at least two, preferably at least four, different nozzle modules from all four different nozzle module groups.

Each of the different nozzle modules from the different nozzle module groups can be interchangeably mounted on one and the same base module. To this end, most preferably, all of the nozzle modules from the different nozzle module groups have the same connecting means.

As the table indicates, in the set of nozzles according to the invention, to each nozzle module of a nozzle module group, a nozzle module of at least one different nozzle module group can be dedicated, which nozzle module has the same medium flow rate under the same spray conditions. The nozzle modules with the same nozzle size have the same medium flow rate, especially within one pressure spray painting technique. For example, the 1.1 HVLP O-nozzle module has the same medium flow rate of 135 g/min as the 1.1 HVLP I-nozzle module, the 1.2 HVLP O-nozzle module has the same medium flow rate as the 1.2 HVLP I-nozzle module and so on. The same applies to the compliant nozzle modules. For example, the 1.1 compliant O-nozzle module has the same medium flow rate of 155 g/min as the 1.1 compliant I-nozzle module, the 1.2 compliant O-nozzle module has the same medium flow rate as the 1.2 compliant I-nozzle module and so on.

The table further indicates that the spray jets generated by means of the low-pressure nozzle modules, here HVLP-nozzle modules, and the spray jets generated by means of the high-pressure nozzle modules, here compliant nozzle modules, can have the same cross-sectional shape, in particular such that the spray jets generated by means of the low-pressure nozzle modules and the spray jets generated by means of the high-pressure nozzle modules have a cross section with, at least in certain parts, a substantially constant width (I-nozzle modules) or a cross section with a substantially oval, in particular substantially elliptical shape (O-nozzle modules). This allows the user to exchange, for example, a nozzle module from the nozzle module group 10 for a nozzle module from the nozzle module group 30, and thus to switch from the low-pressure spraying method, in particular HVLP spraying method, to the high-pressure spraying method, in particular compliant spraying method, without having to do without the O-jet, which is ideal for the user's mode of operation. Similarly, the user can exchange a nozzle module from the nozzle module group 20 for a nozzle module from the nozzle module group 40, and thus to switch from the low-pressure spraying method, in particular HVLP spraying method, to the high-pressure spraying method, in particular compliant spraying method, without having to do without the I-jet, which is ideal for the user's mode of operation.

In addition to the advantages mentioned above, the set of nozzles according to the present invention has the additional advantage that the user can exchange, for example, a nozzle module from the nozzle module group 10 for a nozzle module from the nozzle module group 20, and thus is able to replace a nozzle module which generates an O-jet, which allows a fast coating application, for a nozzle module which generates an even more readily controllable I-jet, without having to give up working with the desired HVLP type of pressure spray painting technique and, in particular, without having to accept changes in the medium flow rate as a tradeoff. Similarly, it is possible to switch from a nozzle module from the nozzle module group 30 to a nozzle module from the nozzle module group 40, without having to give up the desired compliant pressure spray painting technique and, in particular, without having to accept changes in the medium flow rate as a tradeoff. Vice versa switches are, of course, possible as well.

Using the set of nozzles according to the invention, the user can choose the nozzle module ideal for the painting job at hand and/or the mode of operation desired. As a rule, the ideal nozzle module can be selected based on a number of different attributes, especially based on the previously used nozzle module of a set of nozzles according to the invention, on the previously used nozzle module of a different set of nozzles, on the type of pressure spray painting technique desired, on the spray gun model to be used, the manufacturer of the spray gun to be used, the type of medium to be sprayed, the viscosity of the medium to be sprayed, the recommendation of the manufacturer of the medium to be sprayed, the desired shape of the spray jet, the coating thickness required, the ambient conditions, especially the temperature and the relative air humidity inside the painting booth, based on whether the user attaches greater importance to the painting speed or to good controllability of the coating application, and/or on the nozzle size desired. When making this selection, in particular, the method according to the invention for selecting a nozzle module from a set of nozzles for a paint job, the selection system and/or the inventive computer program product according to the invention is/are helpful.

Figure 4:
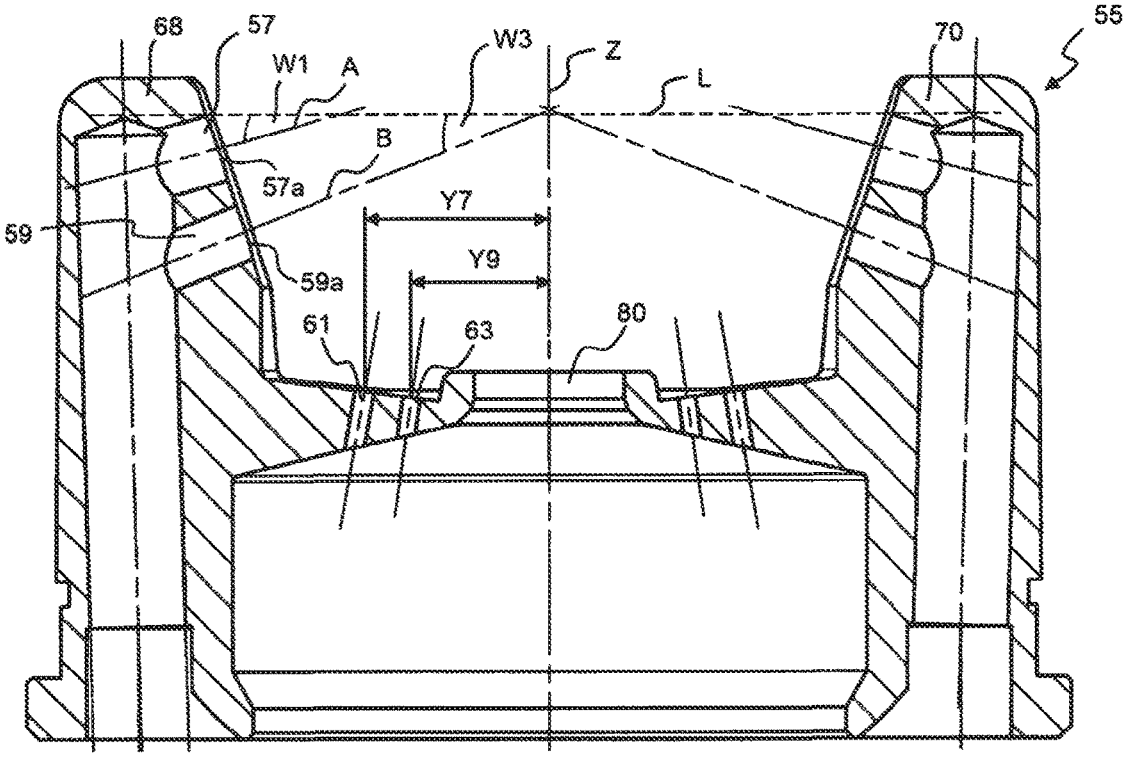
FIG. 4 a sectional view of a first air cap of a nozzle module of an illustrative embodiment of a set of nozzles according to the invention, and FIG. 5 a sectional view of a second air cap of a different nozzle module of an illustrative embodiment of a set of nozzles according to the invention.

FIG. 4 shows a sectional view of a first air cap 55 of a nozzle module of an embodiment of a set of nozzles according to the invention. The air cap 55 comprises a first horn 68 and a second horn 70. A vertical axis L extends perpendicularly relative to the central axis Z of the first air cap 55, with the central axis Z extending through the center of the central aperture 80. The central axis A of an external horn air outlet channel 57 forms a defined angle with the vertical axis L, and the central axis B of an internal horn air outlet channel 59 forms a defined second angle with the vertical axis L. In the present embodiment, it can be assumed that the major portion of the horn air, which flows out of the external horn air outlet aperture 57*a* of the external horn air outlet channel 57, follows the central axis A of the external horn air outlet channel 57, and that the center of this horn air jet is located on the central axis A of the external horn air outlet channel 57. Similarly, it can also be assumed that the major portion of the horn air, which flows out of the internal horn air outlet aperture 59*a* of the internal horn air outlet channel 59, follows the central axis B of the internal horn air outlet channel 59, and that the center of this horn air jet is located on the central axis B of the internal horn air outlet channel 59. The angle, which the central axis A of the external horn air outlet channel 57 forms with the vertical axis L, can therefore be referred to as the external horn air outflow angle W1, and the angle, which the central axis B of the internal horn air outlet channel 59 forms with the vertical axis L, can be referred to as the internal horn air outflow angle W3. Preferably, the horn air outlet channels of the second horn 70 lying opposite to the horn air outlet channels mentioned form the same angles with the vertical axis L.

FIG. 4 further shows the external control bore 61 and the internal control bore 63 which are located, respectively, at an external control bore distance Y7 and an internal control bore distance Y9 relative to the central axis Z of the first air cap 55.

Figure 5:
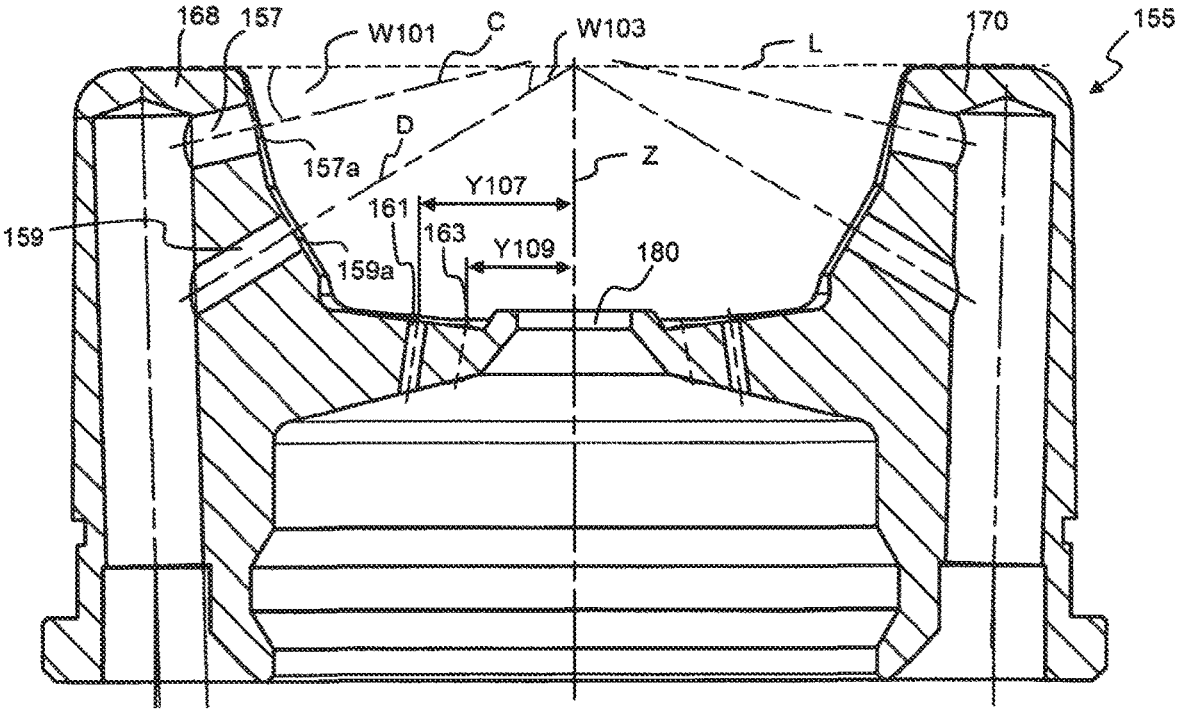

FIG. 5 shows a sectional view of a second air cap 155 of a different nozzle module of an embodiment of a set of nozzles according to the invention. The air cap 155 comprises a first horn 168 and a second horn 170. Here again, the vertical axis L extends perpendicularly relative to the central axis Z of the second air cap 155, with the central axis Z extending through the center of the central aperture 180. The central axis C of an external horn air outlet channel 157 forms a defined angle with the vertical axis L, and the central axis D of an internal horn air outlet channel 159 forms a second angle with the vertical axis L. In the embodiment at hand, it can again be assumed that the main portion of the horn air, which flows out of the external horn air outlet aperture 157*a* of the external horn air outlet channel 157, follows the central axis C of the external horn air outlet channel 157 and that the center of this horn air jet is located on the central axis C of the external horn air outlet channel 157. Similarly, it can be assumed that the main portion of the horn air, which flows out of the internal horn air outlet aperture 159*a* of the internal horn air outlet channel 159, follows the central axis D of the internal horn air outlet channel 159 and that the center of this horn air jet is located on the central axis D of the internal horn air outlet channel 159. The angle, which the central axis C of an external horn air outlet channel 157 forms with the vertical axis L, can therefore be referred to as the external horn air outflow angle W101, and the angle, which the central axis D of an internal horn air outlet channel 159 forms with the vertical axis L, can be referred to as the internal horn air outflow angle W103. Preferably, the horn air outlet channels of the second horn 170 lying opposite to the horn air outlet channels mentioned form the same angles with the vertical axis L.

FIG. 5 also shows an external control bore 161 which is located at an external control bore distance Y107 relative to the central axis Z of the second air cap 155. Since the control bores in this air cap 155 are arranged in the form of a triangle—wherein the apex of the triangle is oriented in the direction of the internal or the external horn air outlet apertures, i.e., only the control bore 161, which forms the apex of the triangle, is in line with the internal horn air outlet aperture 159*a*, the external horn air outlet aperture 157*a* and the center of the central aperture 180 in the air cap 155, and the sectional plane extends only through the control bore 161, the internal horn air outlet aperture 159*a* and the external horn air outlet aperture 157*a*—the two other control bores on one side of the central aperture 180 and the two other control bores on the other side of the central aperture 180 are not visible, but are here only tentatively identified by their central axes. The internal control bore distance Y109 is the distance between the central axis Z and an axis extending parallel to this central axis Z through a projection of the center of the respective control bore onto the sectional plane.

In a nozzle module with the air cap 55, the sum of the angles W1 plus W3 can differ from the sum of the angles W101 plus W103 in a different nozzle module with the air cap 155. The nozzle modules can be part of the same nozzle module group.

Finally, it should be noted that the illustrative embodiments discussed describe only a limited number of possible embodiments and therefore in no way constitute a limitation of the present invention.

The invention claimed is:

1. A set of nozzles for a spray gun, the set comprising at least one nozzle module group with at least two different nozzle modules for mounting in or on one and the same base module of the spray gun, wherein the different nozzle modules are designed such that the different nozzle modules have different medium flow rates under the same spray conditions, with spray jets generated by the different nozzle modules having substantially the same spray jet section height and substantially the same spray jet section width, with the spray jet sections of the different nozzle modules being congruent.

2. The set of nozzles as in claim 1, wherein the set of nozzles further includes at least one additional nozzle module group which comprises at least two, different nozzle modules for mounting in or on one and the same base module, with the different nozzle modules of the additional nozzle module group being designed such that the different nozzle modules of the additional nozzle module group have different medium flow rates under the same spray conditions and that the spray jets generated by the different nozzle modules have substantially the same spray jet section height and substantially the same spray jet section width, with the spray jet sections of the different nozzle modules being congruent, with the spray jets generated by the different nozzle modules of the two nozzle module groups each having different cross-sectional shapes, such that the spray jets generated by the different nozzle modules of one nozzle module group have a cross section with, in at least in certain parts, a substantially constant width and the spray jets generated by the different nozzle modules of the additional nozzle module group have a cross section with a substantially oval shape.

3. The set of nozzles as in claim 2, wherein the set of nozzles further has at least one additional (third) nozzle module group which comprises at least two different nozzle modules for mounting in or on one and the same base module, with the different nozzle modules of the third nozzle module group being designed such that the different nozzle modules of the third nozzle module group have different flow rates under the same spray conditions and wherein the spray jets generated by the different nozzle modules have substantially the same spray jet section height and substantially the same spray jet section width, such that the spray jet sections of the different nozzle modules are congruent, with the different nozzle modules of one nozzle module group being configured as low-pressure nozzle modules and the different nozzle modules of the third nozzle module group being configured as high-pressure nozzle modules.

4. The set of nozzles as in claim 3, wherein the spray jets generated by the low-pressure nozzle modules and the spray jets generated by the high-pressure nozzle modules have the same cross-sectional shape, with, at least in certain parts, a substantially constant width or a cross section with a substantially oval shape.

5. The set of nozzles as in claim 1, wherein the set of nozzles has at least two different nozzle module groups, with the different nozzle modules of the nozzle module groups being designed such that, to each nozzle module of a nozzle module group, a nozzle module of at least one other nozzle module group or groups can be dedicated, which nozzle module has the same medium flow rate under the same spray conditions.

6. The set of nozzles as in claim 1, wherein the nozzle modules each comprises at least one air cap, each with at least two horns with at least one internal horn air outlet aperture and one external horn air outlet aperture, wherein horn air flows out of the at least one external horn air outlet aperture at a defined external horn air outflow angle relative to a vertical axis, with the vertical axis extending perpendicularly relative to a central axis of the air cap, wherein horn air flows out of the at least one internal horn air outlet aperture at a defined internal horn air outflow angle relative to the vertical axis, and wherein the sums of the external horn air outflow angle and the internal horn air outflow angle within a nozzle module are different in the different nozzle modules of at least one nozzle module group.

7. The set of nozzles as in claim 1, wherein the nozzle modules each have at least one air cap, each with at least one central aperture and at least two control bores, with the control bores being arranged diametrically to each other on opposite sides of the at least one central aperture and at a defined control bore distance relative to the at least one central aperture, wherein the control bore distance in the different nozzle modules of at least one nozzle module group is different.

8. The set of nozzles as in claim 1, wherein the different nozzle modules each have at least one spray medium nozzle with a substantially hollow-cylindrical front section and a spray medium outlet aperture, with the inside diameter of the spray medium outlet aperture and/or the axial extension of the substantially hollow-cylindrical front section of the spray medium nozzle being different in the different nozzle modules of at least one nozzle module group.

9. The set of nozzles as in claim 1, wherein the different nozzle modules of a nozzle module group are designed such that, under the same spray conditions, the medium flow rate between nozzle modules, which consecutively follow each other at increasing medium flow rates, each increases by an equidistant value.

10. A spray gun system, wherein the spray gun system comprises at least one set of nozzles as in claim 1 and a base module, with the different nozzle modules of the set of nozzles being interchangeably mounted on the base module.

11. A method for embodying a nozzle module for a set of nozzles as in claim 1, the method comprising:

specifying at least one spray jet section height and/or one spray jet section width and/or one cross-sectional shape of a spray jet to be generated by the nozzle module, constructing the nozzle module which generates a spray jet with the defined spray jet section height and/or spray jet section width and/or shape of the spray jet section, wherein construing the nozzle module includes constructing an air cap by adapting an external horn air outflow angle and/or an internal horn air outflow angle and/or a control bore distance to a medium flow rate and/or to an internal nozzle pressure of the nozzle module, with the external horn air outflow angle being the angle, at which horn air flows out of an external horn air aperture of the air cap relative to a vertical axis, with the vertical axis extending at right angles relative to a central axis of the air cap, with the internal horn air outflow angle being the angle, at which horn air flows out of an internal horn air outlet aperture of the air cap relative to the vertical axis, and with the control bore distance being the distance between at least one control bore in the air cap and a central aperture in the air cap.

12. The method as in claim 11, wherein the method includes producing the nozzle module.

13. A method for selecting a nozzle module from a set of nozzles as in claim 1 for a paint job, the method comprising selecting and/or specifying one or a plurality of the following attributes of the painting job: the previously used nozzle module of a set of nozzles, the previously used nozzle module of a different set of nozzles, the pressure spray painting technique, the spray gun model, the spray gun manufacturer, the type of medium to be sprayed, the viscosity of the medium to be sprayed, the recommendation of the manufacturer of the medium to be sprayed, the shape of the spray jet, the coating thickness, the ambient condition, the painting speed, the controllability, the nozzle size, and wherein, based on the selection and/or specification, a proposal for a nozzle module of the set of nozzles is generated.

14. A selection system, for implementing the method as in claim 13, wherein the system comprises selection and input means for selecting and inputting attributes of the paint job and means for generating and displaying a proposal for a nozzle module of the set of nozzles.

15. A computer program product, wherein the computer program product comprises commands which, during execution of the program by a data processing device, cause the program to generate a method of the selection system as in claim 14.

* * * * *